US005760550A

United States Patent [19]

Sukeno et al.

[11] Patent Number: 5,760,550

[45] Date of Patent: Jun. 2, 1998

[54] COLOR PICTURE TUBE

[75] Inventors: Masahiko Sukeno, Hyogo; Takashi Watanabe, Osaka, both of Japan

[73] Assignee: Matsushita Electronics Corporation, Osaka, Japan

[21] Appl. No.: 706,224

[22] Filed: Sep. 3, 1996

[30] Foreign Application Priority Data

Sep. 5, 1995 [JP] Japan ..... 7-228421
Dec. 13, 1995 [JP] Japan ..... 7-323414

[51] Int. Cl.[6] ..... H01J 29/58

[52] U.S. Cl. ..... 315/382.1; 315/14; 313/414

[58] Field of Search ..... 315/382.1, 382, 315/14, 15; 313/414, 449

[56] References Cited

U.S. PATENT DOCUMENTS

| | | | |
|---|---|---|---|
| 4,366,414 | 12/1982 | Hatayama et al. . | |
| 4,814,670 | 3/1989 | Suzuki et al. | 315/15 |
| 4,886,999 | 12/1989 | Yamane et al. | 313/414 |
| 5,061,881 | 10/1991 | Suzuki et al. | 315/382 |
| 5,128,586 | 7/1992 | Ashizaki et al. | 313/414 |
| 5,281,892 | 1/1994 | Kweon et al. | 313/414 |
| 5,300,855 | 4/1994 | Kweon | 313/414 |
| 5,434,471 | 7/1995 | Jeong | 313/414 |
| 5,483,128 | 1/1996 | Chen | 315/382 |

FOREIGN PATENT DOCUMENTS

| | | |
|---|---|---|
| 0 124 941 | 11/1984 | European Pat. Off. . |
| 0 241 218 | 10/1987 | European Pat. Off. . |
| 2 287 104 | 4/1976 | France . |
| 2 410 358 | 6/1979 | France . |
| 25 37 979 | 3/1977 | Germany . |
| 36 14 700 | 11/1986 | Germany . |
| 38 39 389 | 6/1989 | Germany . |
| 44 15 812 | 11/1994 | Germany . |
| 61-99249 | 5/1986 | Japan . |
| 62-237642 | 10/1987 | Japan . |
| 3-93135 | 4/1991 | Japan . |
| 2 236 613 | 4/1991 | United Kingdom . |
| 2 240 212 | 7/1991 | United Kingdom . |
| 2274020 | 7/1994 | United Kingdom . |

OTHER PUBLICATIONS

JP-A 06-068812 (Mar. 11, 1994), *Patent Abstracts of Japan*, vol. 18, No. 308, Jun. 13, 1994.

Yamane, et al., An in-Line Color CRT With Dynamic Beam Shaping For Data Display, *Proceedings of the Society for Information Display (SID)*, vol. 29, No. 1, 1988, pp. 41–45.

*Primary Examiner*—Theodore M. Blum

*Attorney, Agent, or Firm*—Merchant, Gould, Smith, Edell, Welter & Schmidt, P.A.

[57] ABSTRACT

An in-line color picture tube compensates for the distortion in the illuminated spot at the peripheral portion of the screen in a horizontally oblong shape. In particular, with an increase in the beam diameter under large current, or flattening of the panel or increase in the deflection angle, the beam distorted easily. However, such distortion is made to be small by providing a quadrupole lens with strong power. The in-line color picture tube has an electron gun comprising three cathodes that are in-line arranged in horizontal direction, a control electrode, an accelerating electrode and a focusing electrode system. The focusing electrode system comprises a couple of focusing electrodes having the facing portion on which non-circular beam through holes are provided. A predetermined focus voltage is applied to the first focusing electrode. A voltage changing in accordance with a deflection angle of the beam is applied to the second focusing electrode. A beam through holes that are oblong vertically are provided on the control electrode facing the cathode; and the beam through holes that are oblong horizontally are provided on the control electrode facing the accelerating electrode.

24 Claims, 39 Drawing Sheets

COLOR PICTURE TUBE

FIELD OF THE INVENTION

This invention relates to a color picture tube in which a high resolution picture image can be displayed over the entire region of a phosphor screen.

BACKGROUND OF THE INVENTION

An in-line color picture tube in which three electron beam emitting portions are horizontally aligned focuses dynamically three electron beams over the entire region of a phosphor screen by distorting a horizontal deflection magnetic field as a pincushion shape and a vertical deflection magnetic field as a barrel shape. However, by the action of the magnetic field, electron beams are over-focused in the vertical direction at the peripheral portion on the phosphor screen. As a result, the resolution is deteriorated.

In order to solve this problem, one structure is disclosed in Japanese Laid Open Patent No. (Tokkai-Sho) 61-99249. The structure of the electron gun of the prior art is shown in FIG. 64. In FIG. 64, cathodes 1*a*, 1*b* and 1*c*, a control electrode 2, an accelerating electrode 3, a first focusing electrode 6, a second focusing electrode 7 and a final accelerating electrode 8 are sequentially arranged. As shown in FIG. 65, circular beam through holes 2*a*, 2*b* and 2*c* are provided in the control electrode 2. As shown in FIG. 66, beam through holes 6*d*, 6*e* and 6*f* that are oblong vertically (rectangular shaped) are provided on the first focusing electrode 6 facing the second focusing electrode 7. As shown in FIG. 67, beam through holes 7*a*, 7*b* and 7*c* that are oblong horizontally (rectangular shaped) are provided on the second focusing electrode 7 facing the first focusing electrode 6.

A focus voltage Vfoc is applied to the first focusing electrode 6. A compound voltage, in which a dynamic voltage that increases in accordance with an increase in the deflection angle of electron beams is superimposed on the focus voltage Vfoc, is applied to the second focusing electrode 7. As the dynamic voltage is applied, a potential difference forms between the first focusing electrode 6 and the second focusing electrode 7 to make a quadrupole lens. At the same time, between the second focusing electrode 7 and the final accelerating electrode 8, the potential difference decreases to weaken a main lens. The quadrupole lens is generated to cancel the excessive focusing due to the distorted magnetic field in the vertical direction. On the other hand, the main lens is weakened to compensate for the defocusing which is caused by the increase in the distance to the phosphor screen. Consequently, an electron beam can be focused at the peripheral portion of the phosphor screen.

However, an angle of incidence in the horizontal direction is different from that in the vertical direction, thus generating a discrepancy of magnification. Consequently, at a peripheral portion on the phosphor screen, beam spots are distorted as a horizontally oblong shape, that is, the horizontal diameter of beam spots increases and the vertical diameter decreases. The increase in the horizontal diameter of the beam spot deteriorates the resolution, and the decrease in the vertical diameter causes moire, that is, an interference fringe between the scanning line and the arrangement of holes of a shadow mask. A means for expanding beams in the horizontal direction and strongly focusing beams in the vertical direction is suggested, in which the difference of the incident angles of a screen in the horizontal direction and in the vertical direction is decreased so that the distortion as a horizontally oblong ellipse at the peripheral spot is compensated (See Japanese Laid Open Patent No. Tokkai-Hei 3-93135).

In this structure, however, if the beam expands too much in the horizontal direction, the spot becomes large due to the spherical aberration of main lens. In other words, there is a limitation in decreasing a spot diameter in the horizontal direction. Therefore, in the case where the beam expands too much when a large current is passed or flat panel is employed, or the deflection angle is increased, the distortion as a horizontal oblong ellipse cannot be compensated fully at the peripheral spot.

SUMMARY OF THE INVENTION

It is an object of the present invention to provide a color picture tube that can provide high resolution by reducing distortion of the spot at the peripheral portion even in the above-mentioned cases.

According to the present invention, there is provided a color picture tube comprising an electron gun including three cathodes which are in-line arranged in the horizontal direction, a control electrode, an accelerating electrode and a focusing electrode system. In this structure of the electron gun, the focusing electrode system comprises a first focusing electrode to which a predetermined focusing voltage is applied and a second focusing electrode to which a variable voltage is applied that varies in accordance with a deflection angle of a beam, the first and second electrodes have beam through holes that are asymmetric with respect to a beam axis and the control electrode has beam through holes that are oblong vertically.

According to the present invention, there is provided an alternative aspect of the color picture tube comprising three cathodes which are in-line arranged in the horizontal direction, a control electrode, an accelerating electrode and focusing electrode system. In this structure of the electron gun, the focusing electrode system comprises a first focusing electrode to which a predetermined focusing voltage is applied and a second focusing electrode to which a variable voltage is applied that varies in accordance with a deflection angle of an beam, the first and second focusing electrodes have beam through holes that are asymmetric with respect to a beam axis, and the control electrode has beam through holes that are oblong vertically on its side facing the cathode, and beam through holes that are oblong horizontally on its side facing the accelerating electrode.

DETAILED DESCRIPTION OF THE PREFERRED EMBODIMENTS

Figure 1:
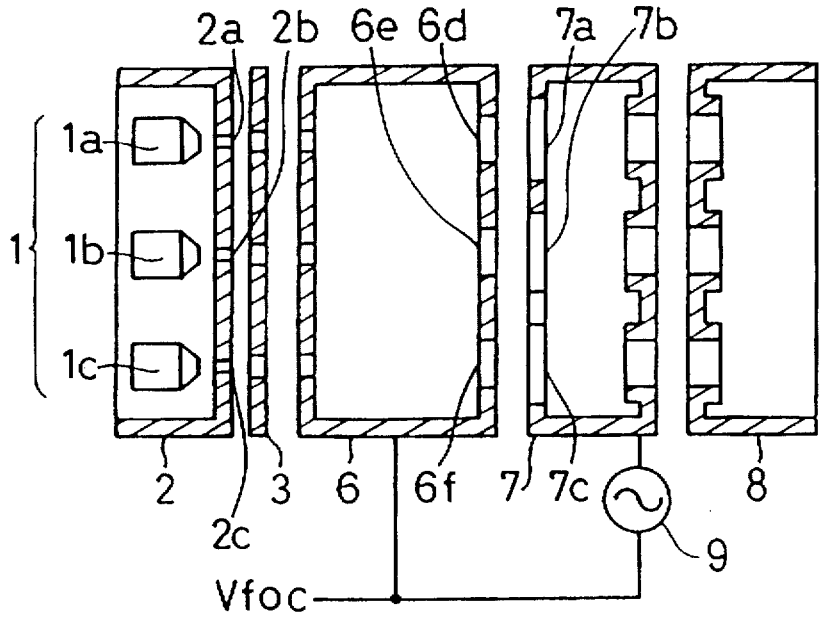
FIG. 1 is a cross sectional view showing a portion of an electron gun of a color picture tube of the first embodiment of the present invention.
Figure 2:
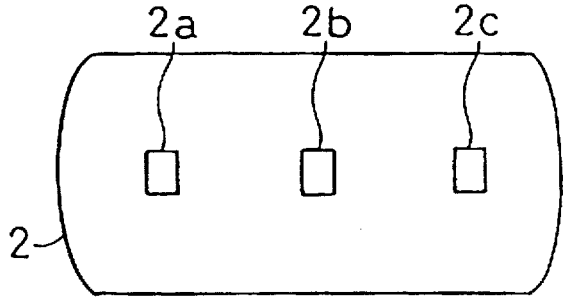
FIG. 2 is an elevational view showing a control electrode of the electron gun according to FIG. 1.
Figure 3:
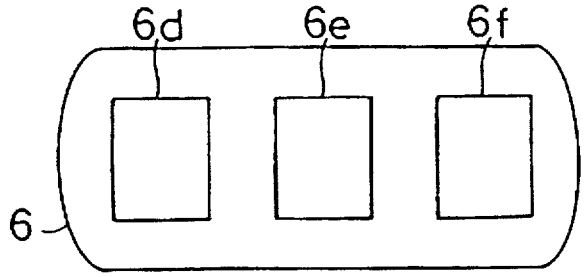
FIG. 3 is an elevational view showing a first focusing electrode of the electron gun according to FIG. 1.
Figure 4:
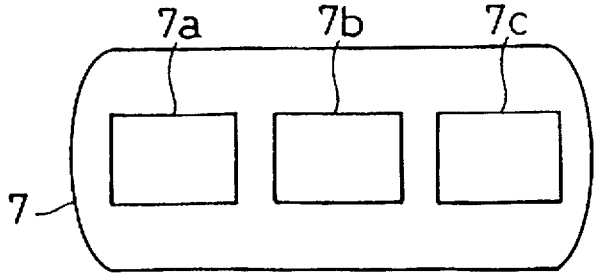
FIG. 4 is an elevational view showing a second focusing electrode of the electron gun according to FIG. 1.

Referring now to FIG. 1 to FIG. 3, there is illustrated a first embodiment of the present invention. As shown in FIG. 1, an in-line electron gun has three cathodes 1*a*, 1*b* and 1*c* which are horizontally aligned, a control electrode 2, an accelerating electrode 3 and a focusing electrode system comprising three electrodes, that is, a first focusing electrode 6, a second focusing electrode 7 and a final accelerating electrode 8. As shown in FIG. 2, beam through holes 2*a*, 2*b* and 2*c* that are oblong vertically (rectangular shaped) are provided on the control electrode 2. As shown in FIG. 3, beam through holes 6*d*, 6*e* and 6*f* that are oblong vertically (rectangular shaped) are provided on a portion of the first focusing electrode 6 facing the second focusing electrode 7. As shown in FIG. 4, beam through holes 7*a*, 7*b* and 7*c* that are oblong horizontally are provided on a portion of the first focusing electrode 6 facing the second focusing electrode 7. The beam through holes of the first focusing electrode 6 and the second focusing electrode 7 are asymmetric with respect to a beam axis. A predetermined focusing voltage Vfoc is applied to the first focusing electrode 6. A compound voltage, in which a dynamic voltage increasing in accordance with an increase in the deflection angle of beams is superimposed on the focusing voltage Vfoc, is applied to the second focusing electrode 7.

Figure 5:
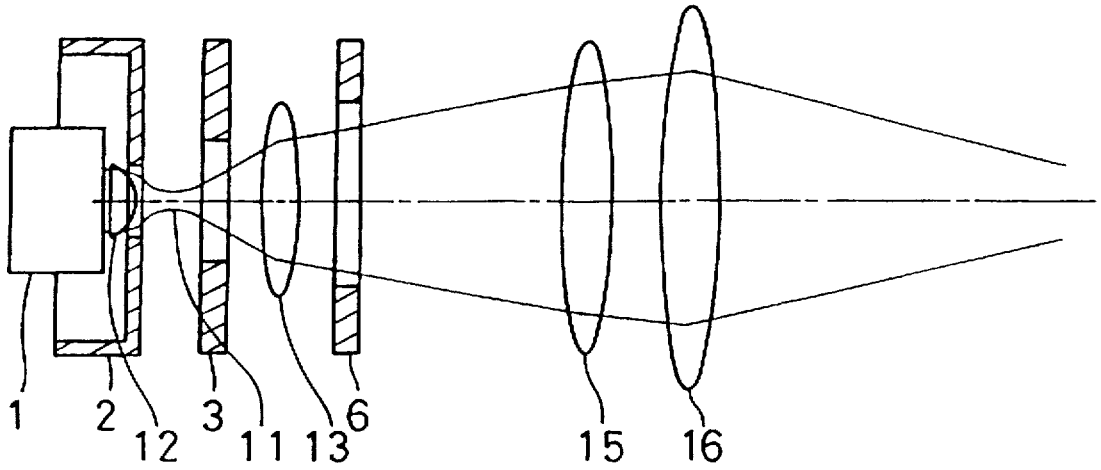
FIG. 5 is a view in which an optical lens is replaced by a horizontal lens field acting on a beam of the electron gun according to FIG. 1.
Figure 6:
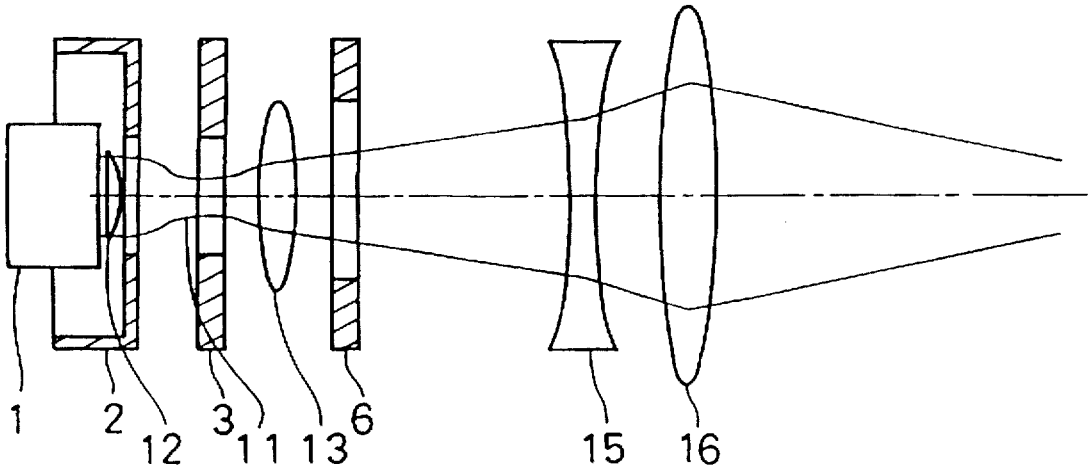
FIG. 6 is a view in which an optical lens is replaced by a vertical lens field acting on a beam of the electron gun according to FIG. 1.
Figure 7:
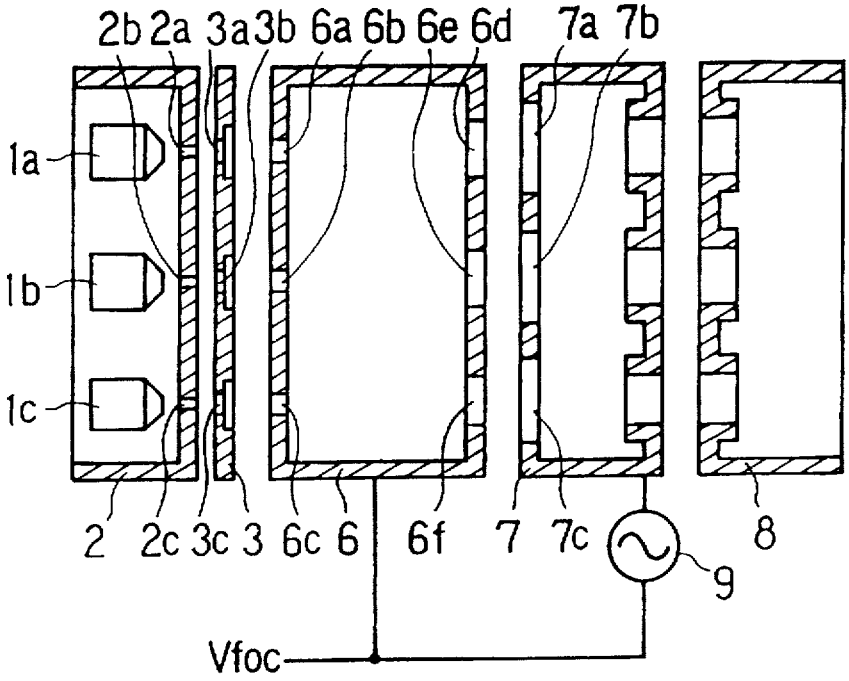
FIG. 7 shows a modification of the electron gun according to FIG. 1.

The electrostatic lens in the horizontal direction will be explained based on FIG. 5; and the electrostatic lens in the vertical direction will be explained based on FIG. 6. As the dynamic voltage is applied, a potential difference is generated between the first focusing electrode 6 and the second focusing electrode 7. Thereby, a quadrupole lens is generated. At the same time, the potential difference between the second focusing electrode 7 and the final accelerating electrode 8 decreases, thus weakening the lens action of the main lens 16. The over-focusing in the vertical direction caused by the distorted magnetic field is cancelled by the generation of the quadrupole lens 15. On the other hand, the main lens 16 weakens to compensate for the defocusing caused by the increase in the distance to the phosphor screen. Consequently, the beams can be well focused at the peripheral portion of the phosphor screen.

The vertically oblong beam through holes of the control electrode 2 are small in the horizontal direction. Thus, the acting area of the cathode becomes small, thereby increasing current density, so that an object point 11 becomes small in the horizontal direction. In addition, a cathode lens 12 acts strongly so that an object point 11 can be located near the cathode. As a result, a beam can be decreasing by the strong lens action of prefocus lens 13. On the contrary, the vertically oblong beam through holes of the control electrode 2 is large in the vertical direction, so that an object point 11 increases and the beam expands in the vertical direction.

A spot is an illuminated area where object point 11 is focused by the lens action and appears as an image. Therefore, in the horizontal direction where the object point 11 is small, the spot becomes small. On the other hand, in the vertical direction where the object point is large, the spot becomes large. Consequently, the distortion of the spot as a horizontally oblong shape can be improved in the peripheral portion of the screen.

Conventionally, in order to compensate for the distortion in the horizontally oblong shape, for example, a method has been employed in which the beam is expanded in the horizontal direction and decreased in the vertical direction by providing beam through holes that are asymmetric axially in an accelerating electrode or the like. However, according to the method of the prior art, in the case where the diameter of the beam is expanded too much under the large current or the like, the spot diameter increases due to the aberration of the main lens. In the present invention, even in the above-mentioned case, the beam is decreased in the horizontal direction, and the beam is not influenced by the aberration of the main lens so that the spot diameter does not increase during the large current. More specifically, the distortion of the spot can be easily compensated.

The above-mentioned effect by the control electrode 2 having beam through holes that are oblong vertically is obtained when the spot is focused at the peripheral portion of the screen. In other words, this effect is enhanced in the electron gun that has the quadrupole lens compensating an over-focusing in the vertical direction due to the magnetic field. If the electron gun does not have a quadrupole lens, this effect cannot be obtained, because the spot in the vertical direction is not focused and the spot with haze in its core portion appears. More specifically, even if the object point in the vertical direction becomes large and the core becomes large, the spot diameter is not changed because of the haze.

For example, in the case where the beam through holes of the control electrode 2 were rectangular, having a horizontal dimension of 0.35 mm and a vertical dimension of 0.45 mm, compared with the conventional circular beam through holes having a diameter of 0.4 mm, the spot diameter decreased by approximately 15% in the horizontal direction and increased by approximately 10% in the vertical direction. In this example, the current value was 0.3 mA. Thus, the distortion of the spot in the horizontally oblong shape of the spot at the peripheral portion can be compensated.

Referring now to FIGS. 7–13, there are illustrated the modifications of the embodiment of FIGS. 1–4. In the modifications shown in FIGS. 7 and 8, the accelerating electrode 3 comprises beam through holes having step-like cross sections. In other words, the accelerating electrode 3 has a horizontally oblong concave portions (rectangular holes) on its side facing the first focusing electrode 6. In the modifications shown in FIGS. 9 and 10, the first focusing electrode 6 comprises beam through holes having step-like cross sections. In other words, the first focusing electrode 6 has a vertically oblong concave portions (rectangular holes) on its side facing the accelerating electrode 3. In the modifications shown in FIGS. 11 to 13, both the accelerating electrode 3 and the first focusing electrode 6 have the beam through holes having the above-mentioned step-like cross sections.

These beam through holes having a step-like cross section act for decreasing the vertical diameter of the beam. In other words, the beam through holes of the control electrode 2 that are oblong vertically can inhibit an excessive increase in the vertical diameter of the beam. As a result, the excessive increase in the vertical diameter of the spot due to the spherical aberration can be inhibited.

Figure 8:
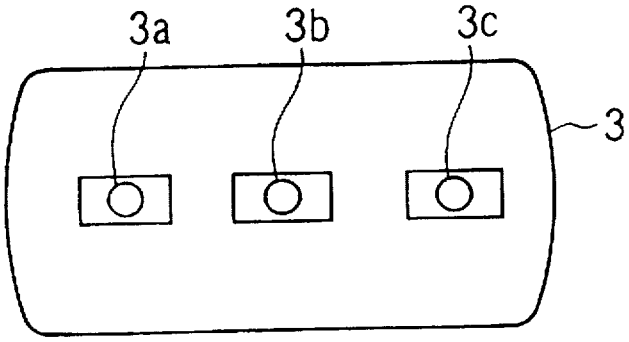
FIG. 8 is an elevational view showing the accelerating electrode of the electron gun according to FIG. 7.
Figure 9:
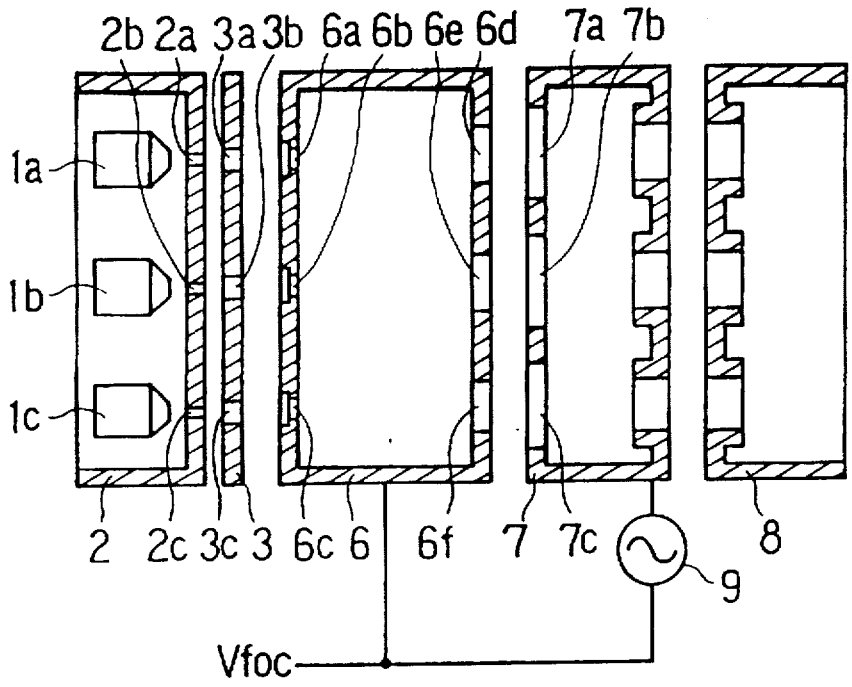
FIG. 9 is a view showing an alternative modification of the electron gun according to FIG. 1.
Figure 10:
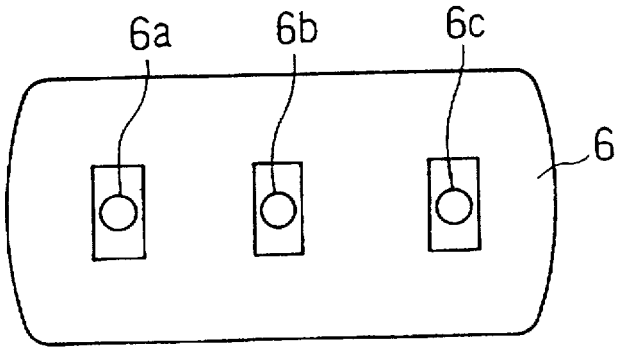
FIG. 10 is an elevational view showing the first focusing electrode of the electron gun according to FIG. 9.
Figure 11:
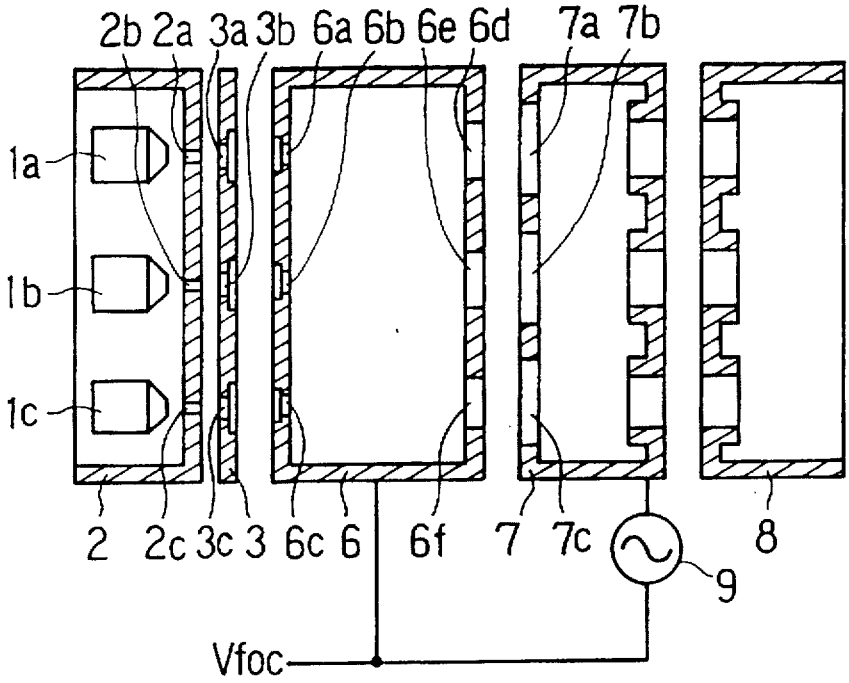
FIG. 11 is a cross sectional view showing an alternative modification of the electron gun according to FIG. 1.
Figure 12:
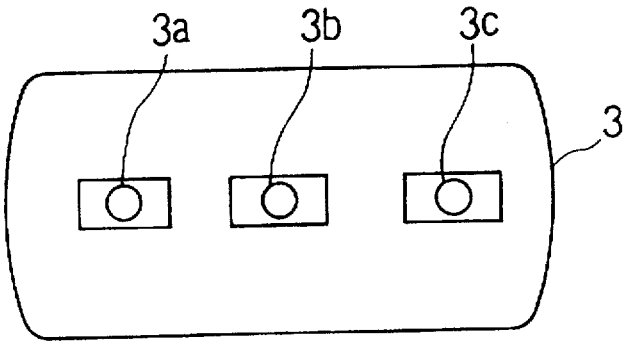
FIG. 12 is an elevational view showing the accelerating electrode of the electron gun according to FIG. 11.
Figure 13:
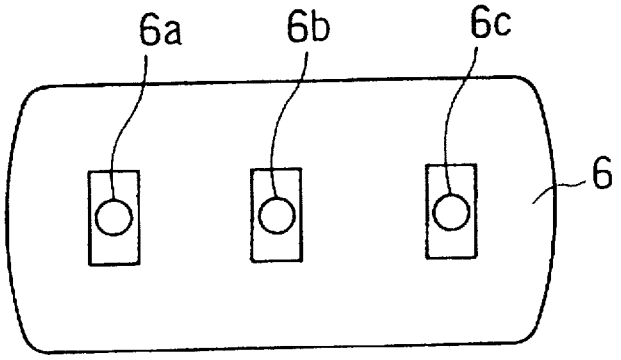
FIG. 13 is an elevational view showing the first focusing electrode of the electron gun according to FIG. 11.
Figure 14:
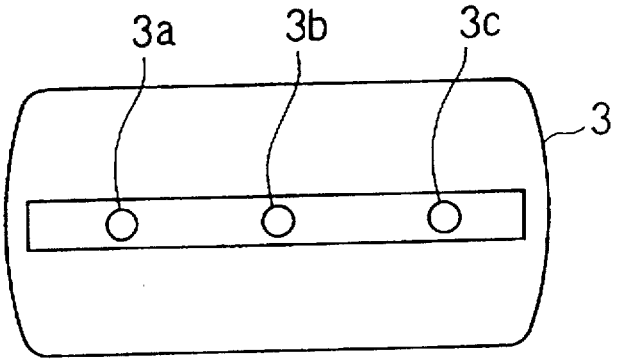
FIG. 14 is an elevational view showing an alternative shape of the accelerating electrode.
Figure 15:
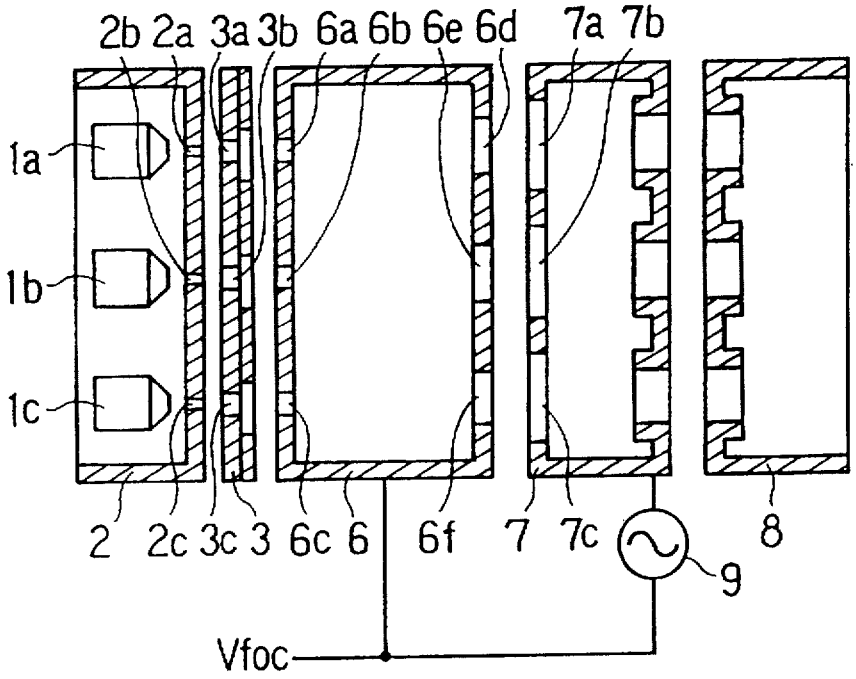
FIG. 15 is a cross sectional view showing the accelerating electrode of the electron gun according to FIG. 7 in which two electrodes are provided.
Figure 16:
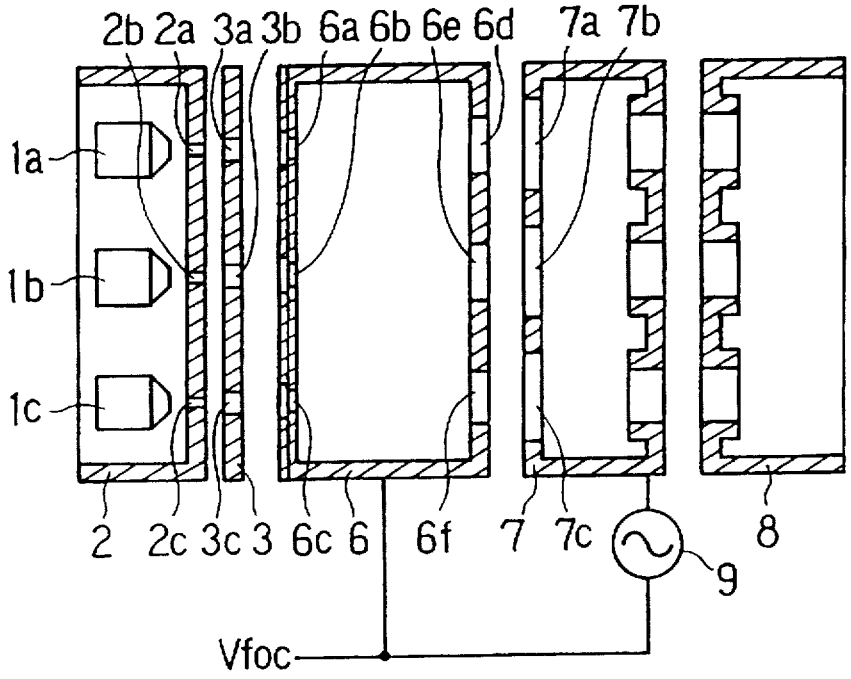
FIG. 16 is a cross sectional view showing the first focusing electrode of the electron gun according to FIG. 9 in which two electrodes are provided.

The three beam through holes are not necessarily surrounded separately by the horizontally rectangular concave portions as shown in FIG. 8. Three beam through holes may be surrounded by one horizontally rectangular concave portion as shown in FIG. 14. Moreover, FIGS. 15 and 16 show an alternative method for forming the beam through holes having the step-like cross section. In this method, circular holes are provided on the accelerating electrode 3 or the first focusing electrode 6, rectangular holes that are oblong horizontally or oblong vertically are provided on a different electrode plate and then the two are welded one over the other.

Figure 17:
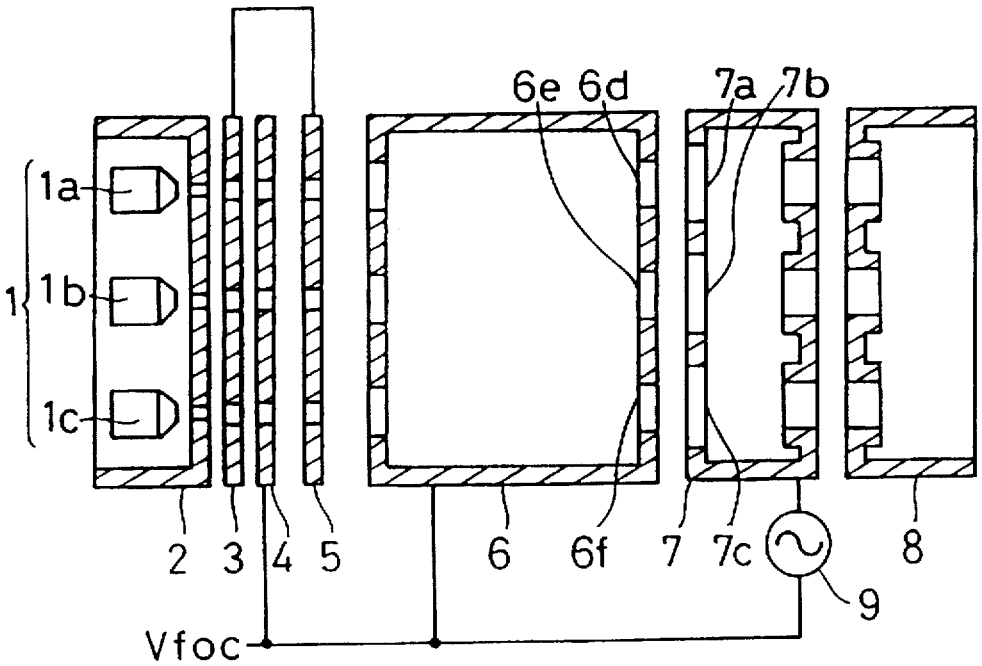
FIG. 17 is a cross sectional view showing a portion of an the electron gun of the color picture tube of the second embodiment of the present invention.
Figure 18:
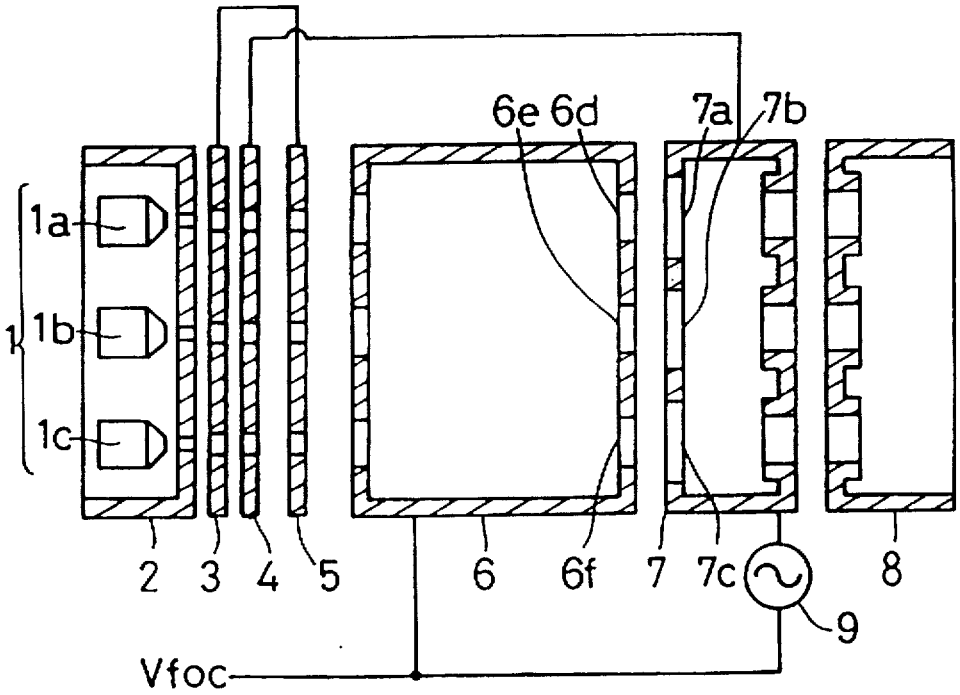
FIG. 18 is a cross sectional view showing a portion of the electron gun of the color picture tube of the third embodiment of the present invention.
Figure 19:
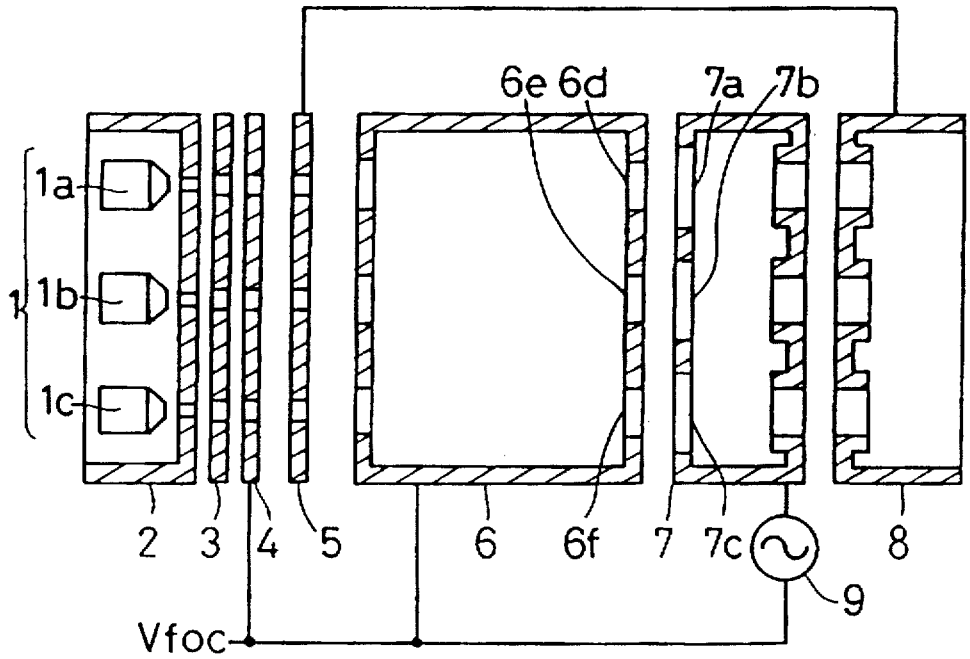
FIG. 19 is a cross sectional view showing a portion of the electron gun of the color picture tube of the fourth embodiment of the present invention.

Referring now to FIGS. 17–19, there are illustrated the second to fourth embodiments of the present invention. As shown in FIG. 17, the second embodiment comprises the electron gun in which the focus voltage Vfoc, which is the same as that applied to the first focusing electrode 6, was applied to the first auxiliary electrode 4, and a voltage, which is the same as that applied to the accelerating electrode 3, was applied to the second auxiliary electrode 5. Referring to FIG. 18, there is shown the third embodiment of the electron gun in which a voltage, which is the same as that applied to the second focusing electrode 7, was applied to the first auxiliary electrode 4, and a voltage, which is the same as applied to the accelerating electrode 3 was applied to the second auxiliary electrode 5. Both the second and third embodiments provide for focusing beams strongly by means of two prefocus lenses. Referring to FIG. 19, there is shown the fourth embodiment of a multi-step focusing type electron gun in which the focus voltage Vfoc, which is the same as that applied to the first focusing electrode 6, was applied to the first auxiliary electrode 4, and a voltage, which is the same as that applied to the accelerating electrode 8, was applied to the second auxiliary electrode 5.

The electron guns according to FIGS. 17–19 have quadrupole lenses. These electron guns have the same structures as the first embodiment except in the lens system that focuses beams on the phosphor screen. Consequently, by means of the control electrode 2 having the beam through holes that are oblong vertically, the distortion of the spot in a horizontally oblong shape can be improved at the peripheral spot in the phosphor screen, as in the first embodiment.

Figure 20:
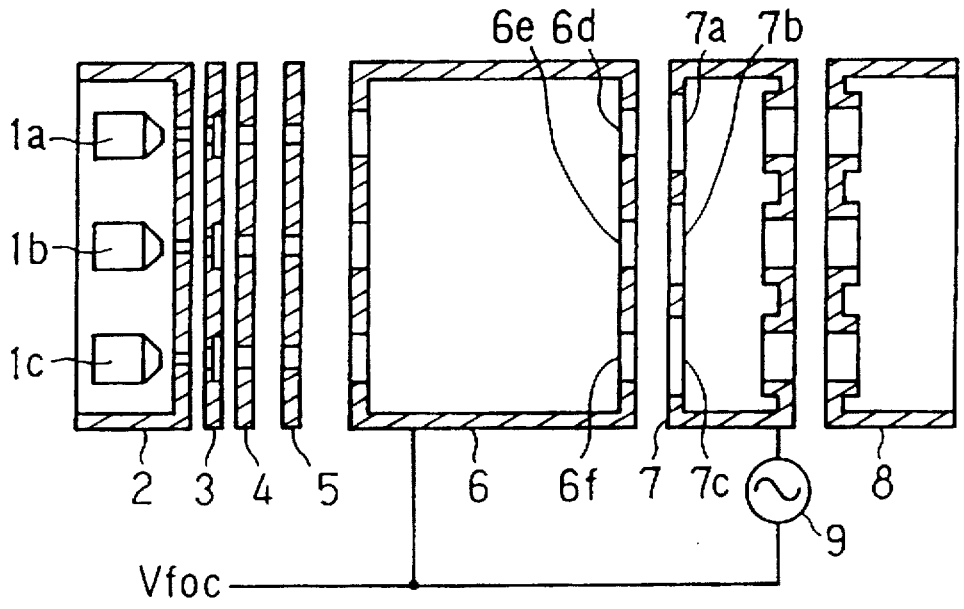
FIG. 20 shows a modification of the electron gun according to FIGS. 17–19.
Figure 21:
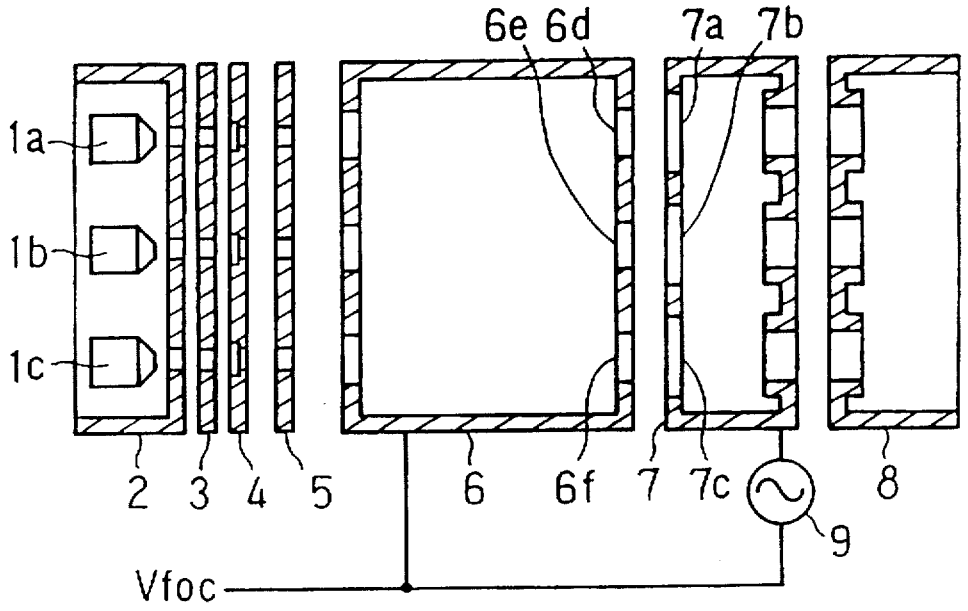
FIG. 21 shows an alternative modification of the electron gun according to FIGS. 17–19.
Figure 22:
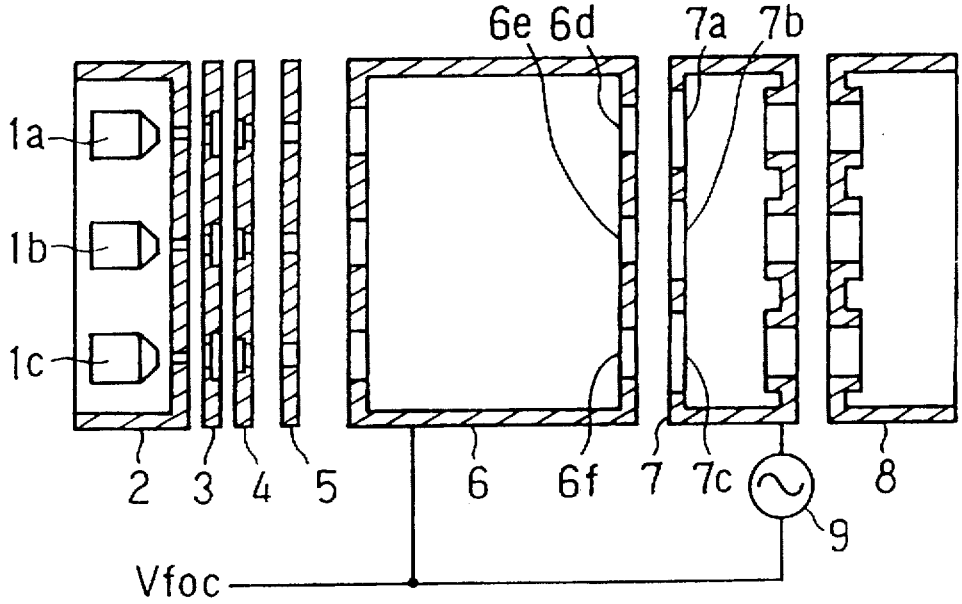
FIG. 22 shows an alternative modification of the electron gun according to FIGS. 17–19.

Referring now to FIGS. 20–22, there are illustrated the modifications of the embodiments of FIGS. 17–19. In the modifications shown in FIG. 20, the accelerating electrode 3 comprises beam through holes having step-like cross sections. The accelerating electrode 3 has horizontally oblong concave portions (rectangular holes) on its side facing the first auxiliary electrode 4. In the modifications shown in FIG. 21, the first auxiliary electrode 4 comprises beam through holes having step-like cross sections. The first auxiliary electrode 4 has horizontally oblong concave portions (rectangular holes) on its side facing the accelerating electrode 3. In the modifications shown in FIG. 22, both the accelerating electrode 3 and the first auxiliary electrode 4 have the beam through holes having the above-mentioned step-like cross sections.

The elevational views of the accelerating electrode 3 and the first auxiliary electrode 4 are omitted, but they are the same as shown in the modification of the first embodiment. Moreover, in FIGS. 20–22, there is not shown the voltage applying line connecting to each of the accelerating electrode 3, the first auxiliary electrode 4 and the second auxiliary electrode 5. But each connection can employ the method shown in FIGS. 17 to 19.

These beam through holes act for focusing beams strongly in the vertical direction. In other words, beam through holes of the control electrode 2 that are oblong vertically can inhibit the excessive increase in the vertical diameter of the beam. As a result, an excessive increase of the vertical diameter of the spot due to the spherical aberration can be inhibited.

The beam through holes of the other electrodes can obtain the same effect by providing the above-mentioned step-like cross section. For example, the vertically oblong concave portions may be provided on the face of the first auxiliary electrode 4 facing the second auxiliary electrode 5, or the face of the first focusing electrode 6 facing the second auxiliary electrode 5. Moreover, the horizontally oblong concave portions can be provided on the face of the second auxiliary electrode 5 facing the first auxiliary electrode 4, or the face of the second auxiliary electrode 5 facing the first focusing electrode 6.

The three beam through holes are not necessarily surrounded separately by the horizontally rectangular concave portions. As shown in FIG. 14, three beam through holes may be surrounded together by one horizontally rectangular concave portion. As a method for forming the beam through holes having the step-like cross section, the same method as shown in FIG. 15, and 16 can be employed. In this method, circular holes were provided on the accelerating electrode 3 or the first auxiliary electrode 4, and the rectangular holes that are oblong horizontally or oblong vertically are provided on the other electrode plate, and then the two were welded one over the other.

Figure 23:
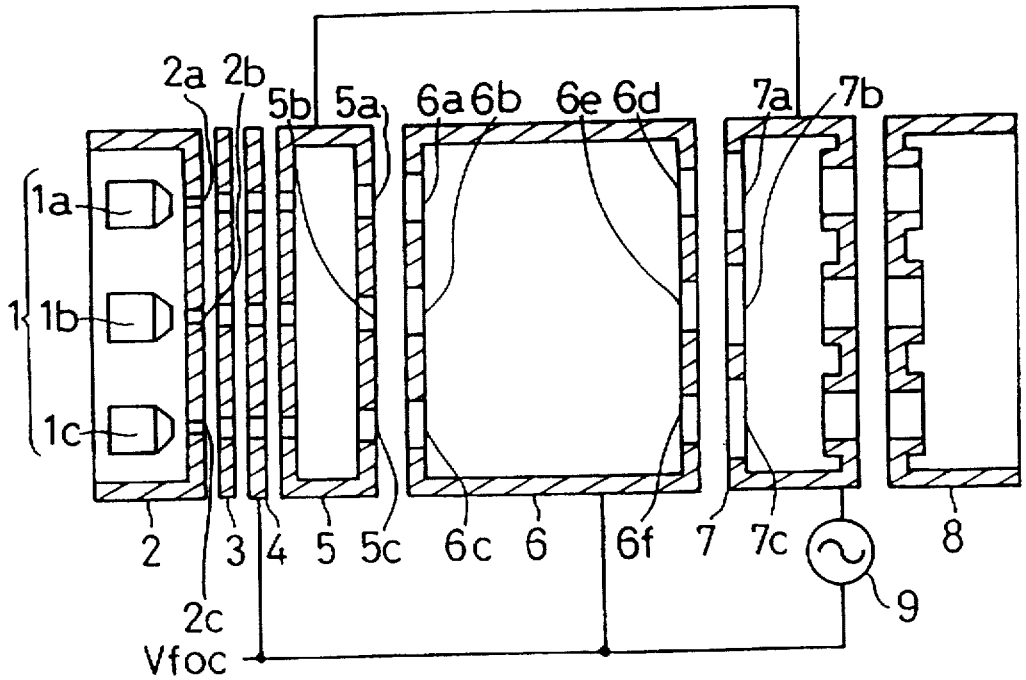
FIG. 23 is a cross sectional view showing a portion of the electron gun of the color picture tube of the fifth embodiment of the present invention.
Figure 24:
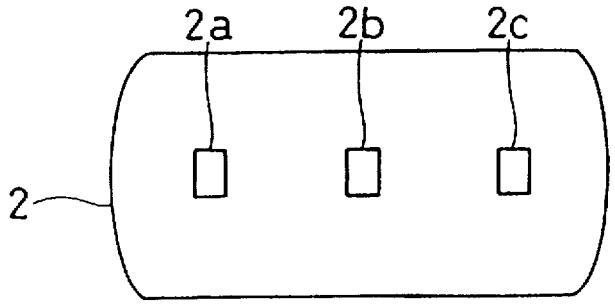
FIG. 24 is an elevational view showing the control electrode of the electron gun according to FIG. 23.
Figure 25:
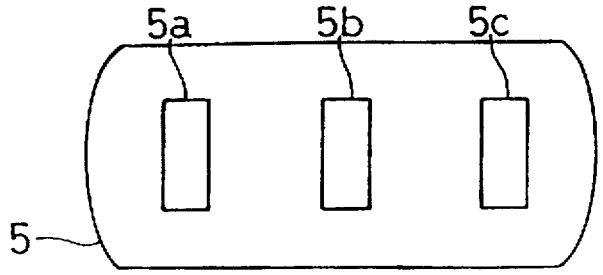
FIG. 25 is an elevational view showing the side of the second control electrode facing the first focusing electrode of the electron gun according to FIG. 23.
Figure 26:
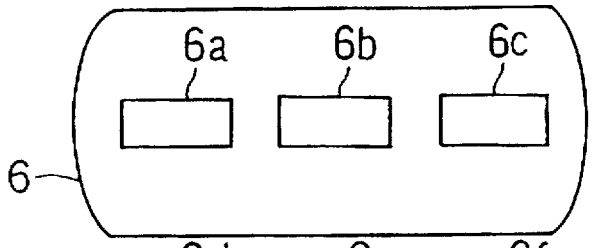
FIG. 26 is an elevational view showing the side of the first focusing electrode facing the second auxiliary electrode of the electron gun according to FIG. 23.
Figure 27:
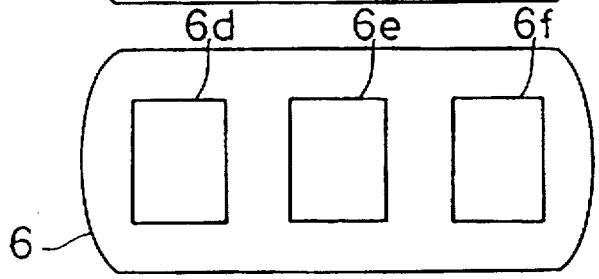
FIG. 27 is an elevational view showing the side of the first focusing electrode facing the second focusing electrode of the electron gun according to FIG. 23.
Figure 28:
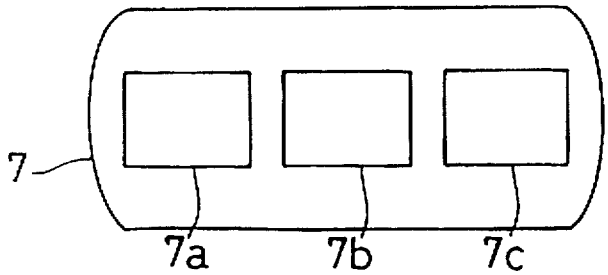
FIG. 28 is an elevational view showing the side of the second focusing electrode facing the first focusing electrode of the electron gun according to FIG. 23.

Referring now to FIG. 23, there is illustrated the fifth embodiment of the present invention. As shown in FIG. 23, the in-line electron gun comprises three cathodes 1*a*, 1*b* and 1*c* which are aligned, a control electrode 2, an accelerating electrode 3, the first auxiliary electrode 4, the second auxiliary electrode 5, the first focusing electrode 6, the second focusing electrode 7 and the final accelerating electrode 8. As shown in FIG. 24, the control electrode 2 comprises beam through holes 2*a*, 2*b* and 2*c* that are oblong vertically (rectangular shaped). As shown in FIG. 25, beam through holes 5*a*, 5*b* and 5*c* that are oblong vertically (rectangular shaped) are provided on the face of the box-like second auxiliary electrode 5 facing the first focusing electrode 6. As shown in FIG. 26, beam through holes 6*a*, 6*b* and 6*c* that are oblong horizontally (rectangular shaped) are provided on the face of the box-like first focusing electrode 6 facing the auxiliary electrode 5. As shown in FIG. 27, beam through holes 6*d*, 6*e* and 6*f* that are oblong vertically (rectangular shaped) are provided on the face of the box-like second focusing electrode 7 facing the first focusing electrode 6. As shown in FIG. 28, beam through holes 7*a*, 7*b* and 7*c* that are oblong horizontally (rectangular shapes) are provided on the face of the box-like second focusing electrode 7 facing the first focusing electrode 6. According to this structure, in a portion where the second auxiliary electrode 5 and the first focusing electrode 6 are facing each other, and a portion where the first focusing electrode 6 and the second focusing electrode 7 are facing each other, the beam through holes are asymmetric with respect to a beam axis. A predetermined focusing voltage Vfoc is applied to the first auxiliary electrode 4 and the first focusing electrode 6. A compound voltage, in which a dynamic voltage increasing in accordance with an increase of the deflection angle of an beam is superimposed on the focusing voltage Vfoc, is applied to the second auxiliary electrode 5 and the second focusing electrode 7.

Figure 29:
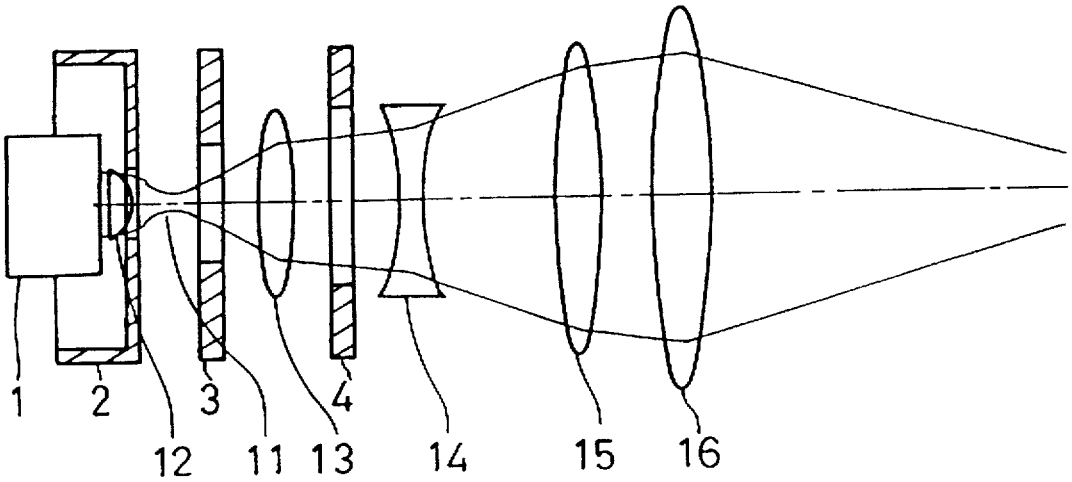
FIG. 29 is a view in which an optical lens is replaced by a horizontal lens field acting on a beam of the electron gun according to FIG. 23.
Figure 30:
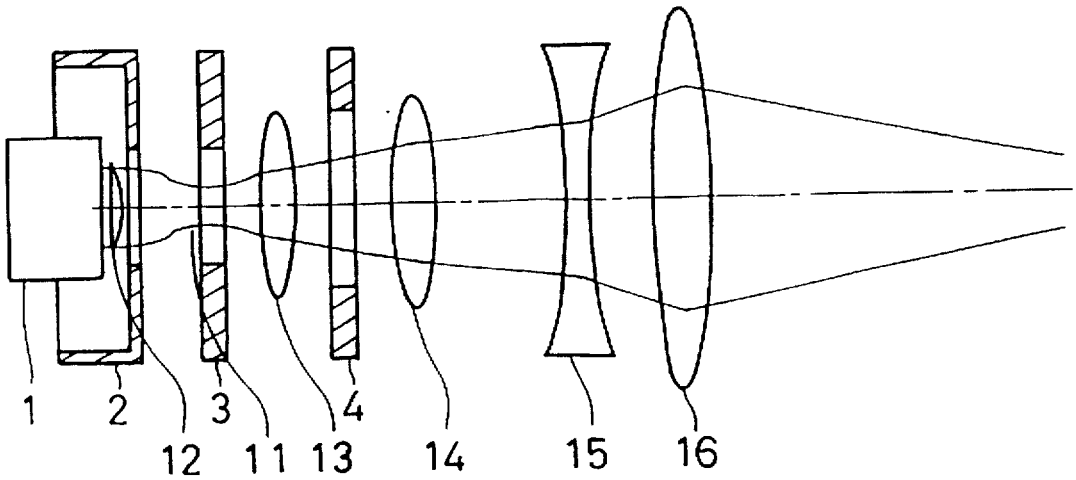
FIG. 30 is a view in which an optical lens is replaced by a vertical lens field acting on a beam of the electron gun according to FIG. 23.

A detailed behavior of the beam in the horizontal direction will be explained based on FIG. 29; and a detailed behavior of the beam in the vertical direction will be explained based on FIG. 30. As the dynamic voltage is applied, a potential difference is generated between the second auxiliary electrode 5 and the first focusing electrode 6, and between the first focusing electrode 6 and the second focusing electrode 7. Thereby, between the second auxiliary electrode 5 and the first focusing electrode 6, the quadrupole lens 14 is generated that expands a beam in the horizontal direction and focuses a beam in the vertical direction. On the other hand, between the first focusing electrode 6 and the second focusing electrode 7, the quadruple lens 15 is generated that expands a beam in the vertical direction and decreases a beam in the horizontal direction. Moreover, between the second focusing electrode 7 and the accelerating electrode 8, the potential difference decreases, thus weakening the main lens 16. The quadrupole lens 15 cancels the excessive focusing in the vertical direction due to the distorted magnetic field. At the same time, the main lens 16, whose lens action weakens, compensates for the defocusing due to the increase in the distance to the phosphor screen during deflection. Consequently, the beams can be focused adequately at the peripheral portion on the phosphor screen.

Moreover, the quadrupole lens 14 makes the difference between the incident angle in the horizontal direction and that in the vertical direction smaller, and reduces the horizontally oblong distortion in the spot at the peripheral portion. However, by the action of the control electrode 2 having beam through holes that are oblong vertically, the horizontal dimension of the beam decreases as compared with the diameter of the conventional circular beam, so that the beam is not expanded excessively. Thereby, the spherical aberration of the main lens 16 can be inhibited and the increase in the horizontal diameter of the spot can be inhibited even under the large current.

As stated above, in the horizontal direction, object point 11 becomes small so that the horizontal diameter of the spot at the peripheral portion can be decreased. In the vertical direction, object point 11 becomes large so that the vertical diameter of the spot at the peripheral portion can be increased. Consequently, the distortion can be compensated better than the case of employing the conventional circular beam through holes.

Figure 31:
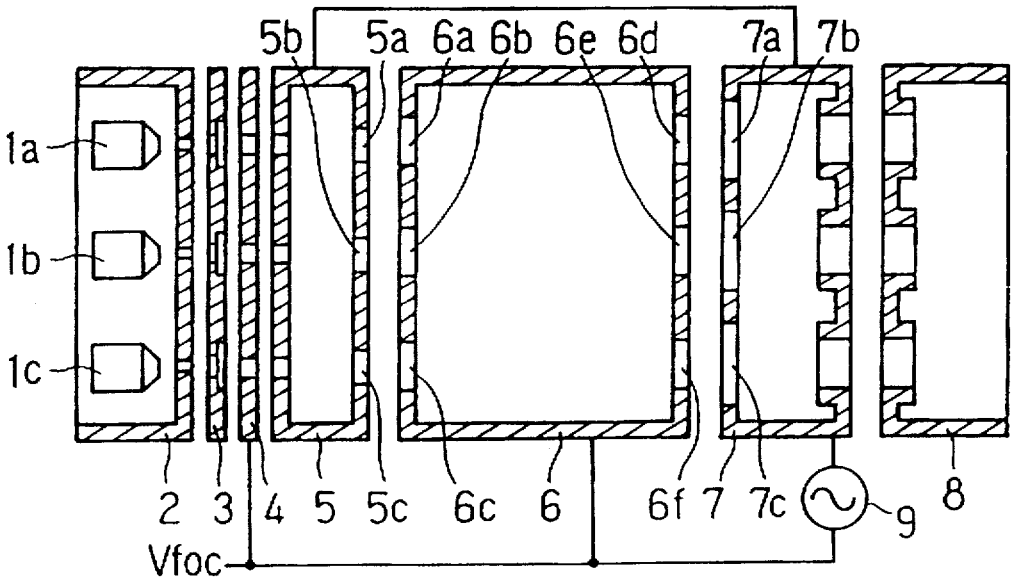
FIG. 31 shows a modification of the electron gun according to FIG. 23.
Figure 32:
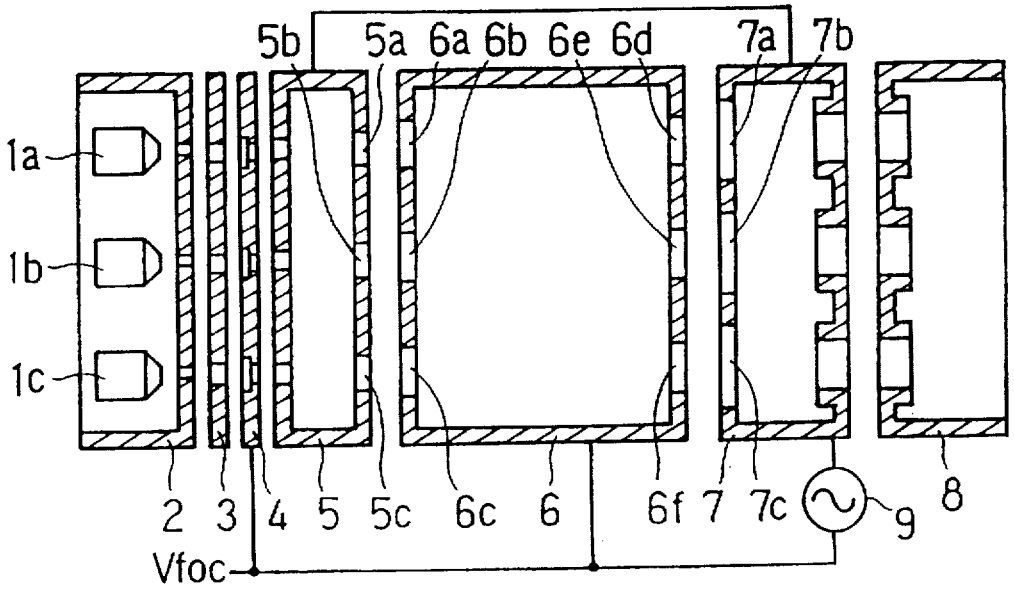
FIG. 32 shows an alternative modification of the electron gun according to FIG. 23.
Figure 33:
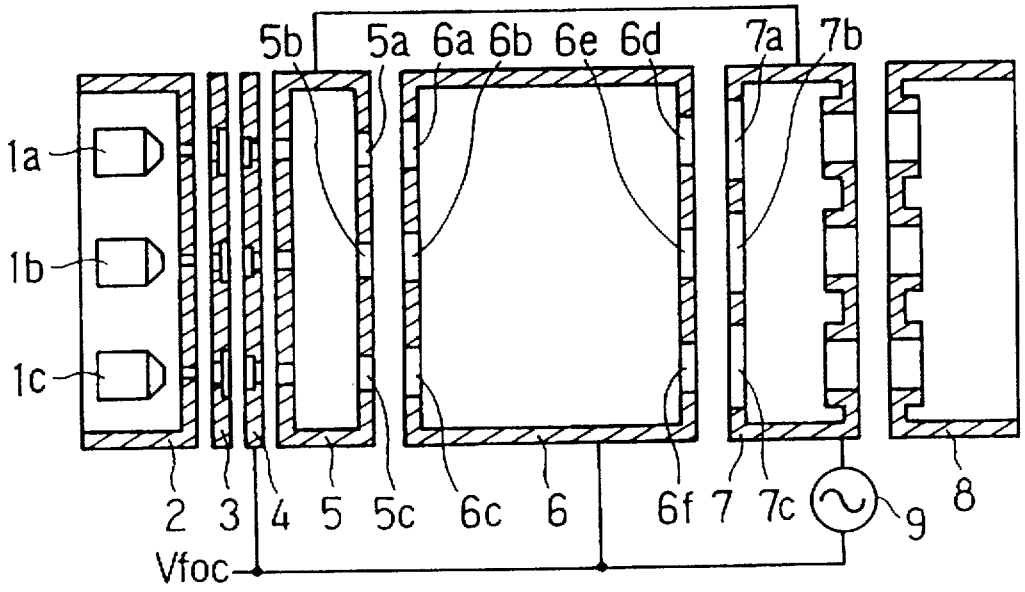
FIG. 33 shows an alternative modification of the electron gun according to FIG. 23.

Referring now to FIGS. 31–33, there are illustrated the modifications of the embodiments of FIGS. 23–28. In the modifications shown in FIG. 31, the accelerating electrode 3 comprises beam through holes having step-like cross sections. The accelerating electrode 3 has horizontally oblong concave portions (rectangular holes) on its side facing the first auxiliary electrode 4. In the modifications shown in FIG. 32, the first auxiliary electrode 4 comprises beam through holes having step-like cross sections. The first auxiliary electrode 4 has vertically oblong concave portions (rectangular holes) on its side facing the accelerating electrode 3. In the modifications shown in FIG. 33, both the accelerating electrode 3 and the first auxiliary electrode 4 have the beam through holes having the above-mentioned step-like cross sections.

These beam through holes act for decreasing beams in the vertical direction. In other words, beam through holes of the control electrode 2 that are oblong vertically can inhibit an excessive increase in the vertical diameter of the beam. As a result, the excessive increase of the vertical diameter of the spot due to the spherical aberration can be inhibited.

The three beam through holes are not necessarily surrounded separately by the horizontally oblong rectangular concave portions. As shown in FIG. 14, three beam through holes may be surrounded together by one horizontally oblong rectangular concave portion. As a method for forming the beam through holes having the step-like cross section, the same method as shown in FIGS. 15 and 16 can be employed. In this method, general circular holes were provided on the accelerating electrode 3 or the first auxiliary electrode 4, and horizontally oblong or vertically oblong rectangular holes were provided on the other electrode plate, and then the two were welded together.

Figure 34:
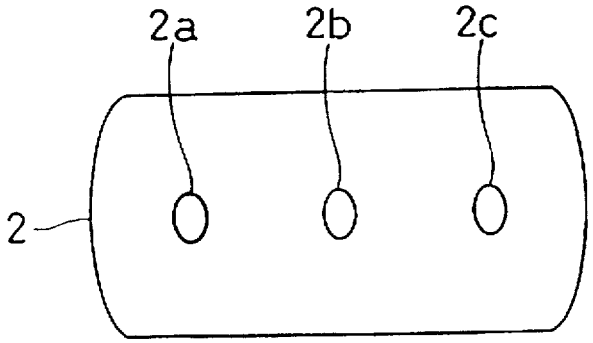
FIG. 34 is an elevational view showing an alternative shape of the control electrode of the electron gun according to FIG. 23.

Moreover, the beam through holes of the control electrode 2 are not necessarily of rectangular shape. They may have an ellipse or oval shape as shown in FIG. 34.

Figure 35:
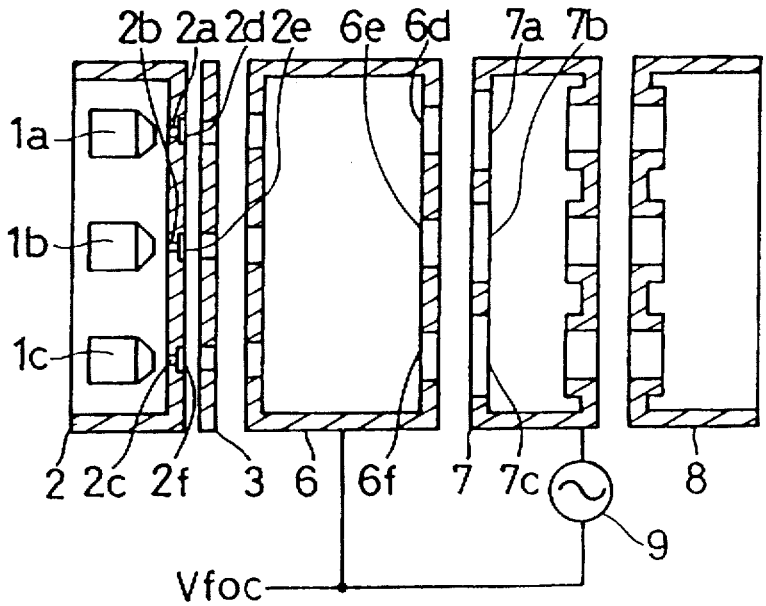
FIG. 35 is a cross sectional view showing a portion of the electron gun of the color picture tube of the sixth embodiment of the present invention.
Figure 36:
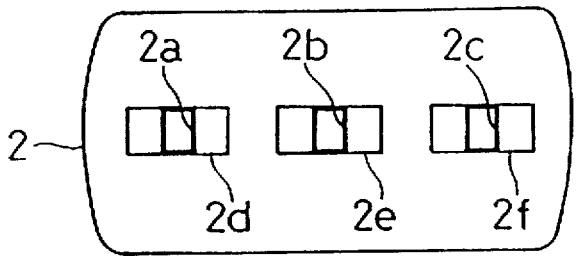
FIG. 36 is an elevational view showing the control electrode of the electron gun according to FIG. 35.

Referring now to FIG. 35, there is illustrated the sixth embodiment of the present invention. As shown in FIG. 35, the in-line electron gun comprises three cathodes 1*a*, 1*b* and 1*c* which are aligned, a control electrode 2, an accelerating electrode 3, the first focusing electrode 6, the second focusing electrode 7 and the final accelerating electrode 8. As shown in FIGS. 35 and 36, beam through holes of the control electrode 2 have step-like cross sections. More specifically, the control electrode 2 has beam through holes 2*a*, 2*b*, and 2*c* that are oblong vertically (rectangular shaped) on its side facing the cathode 1, and beam through holes 2*d*, 2*e*, and 2*f* that are oblong horizontally (rectangular shaped) on its side facing the accelerating electrode 3.

Figure 37:
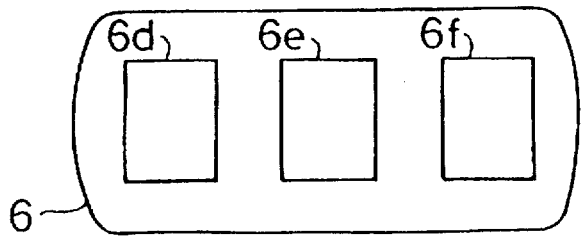
FIG. 37 is an elevational view showing the side of the first control electrode facing the second focusing electrode of the electron gun according to FIG. 35.
Figure 38:
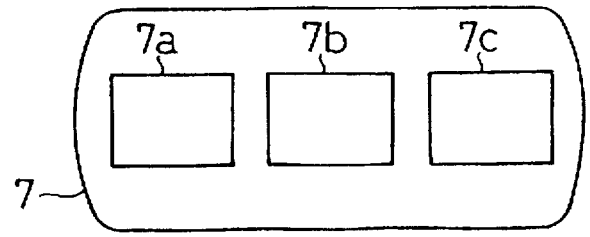
FIG. 38 is an elevational view showing the side of the first focusing electrode facing the second focusing electrode of the electron gun according to FIG. 35.

As shown in FIG. 37, beam through holes 6*d*, 6*e* and 6*f*, that are oblong vertically (rectangular shaped) are provided on the side of the box-type first focusing electrode 6 facing the second focusing electrode 7. As shown in FIG. 38, beam through holes 7*a*, 7*b* and 7*c* that are oblong horizontally (rectangular shaped) are provided on the side of the box-like second focusing electrode 7 facing the first focusing electrode 6. A predetermined focusing voltage Vfoc is applied to the first focusing electrode 6. A compound voltage, in which a dynamic voltage which increases in accordance with an increase in deflection angle of a beam is superimposed on the focus voltage Vfoc, is applied to the second focusing electrode 7.

Figure 39:
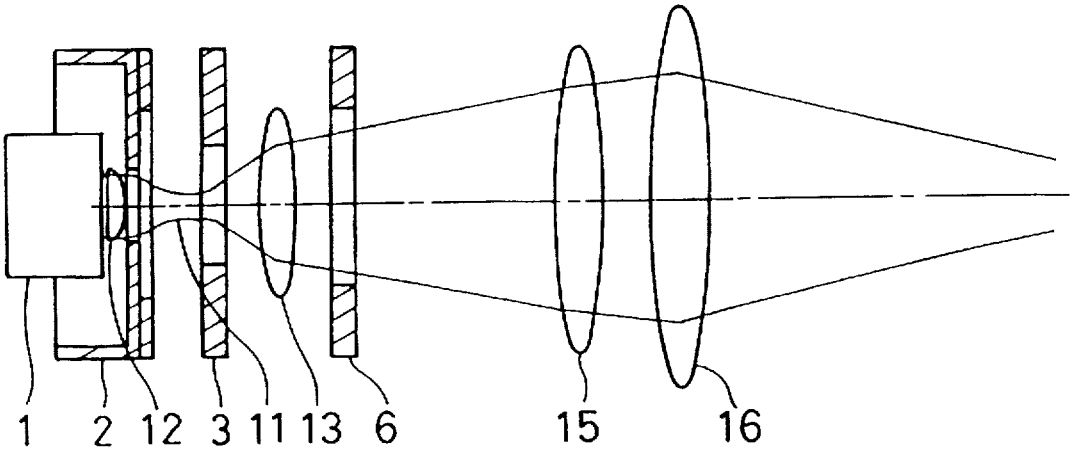
FIG. 39 is a view in which an optical lens is replaced by a horizontal lens field acting on a beam of the electron gun according to FIG. 35.
Figure 40:
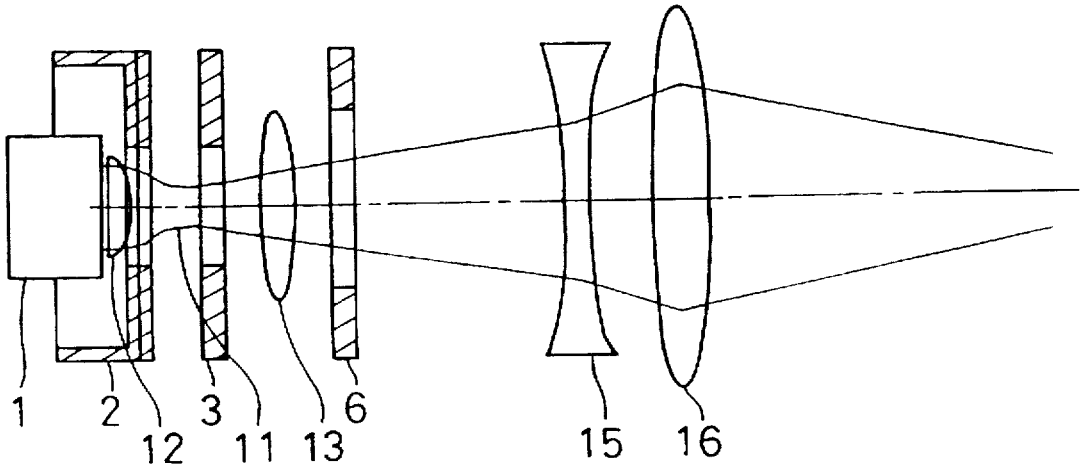
FIG. 40 is a view in which an optical lens is replaced by a vertical lens field acting on a beam of the electron gun according to FIG. 35.

The electrostatic lens in the horizontal direction will be explained based on FIG. 39; and electrostatic lens in the vertical direction will be explained based on FIG. 40. As a dynamic voltage is applied, a potential difference is generated between the first focusing electrode 6 and the second focusing electrode 7. Thereby, a quadrupole lens 15 is generated. At the same time, the potential difference between the second focusing electrode 7 and the final accelerating electrode 8 decreases to thus weaken the main lens 16. The over-focusing in the vertical direction caused by the distortion due to the magnetic field is cancelled by the quadrupole lens 15. On the other hand, the lens action of the main lens 16 weakens, to thus compensate the defocusing caused by the increase in the distance to the phosphor screen. Consequently, a beam can be well focused at the peripheral portion of the phosphor screen.

In FIG. 36, beam through holes are provided on the control electrode 2. As shown in FIG. 39, the spot diameter in horizontal direction is small, so that the acting area of the cathode becomes small and the current density increases. Consequently, the object point 11 becomes small and the location of the object point 11 becomes near to the cathode. On the other hand, in FIG. 40, the spot diameter in vertical direction is large, so that the acting area of the cathode also becomes large and the current density becomes small. Thus the object point 11 becomes large and the object point tends to be generated far from the cathode.

The thickness of the control electrode 2 is small in the horizontal direction and large in the vertical direction. Therefore, the action of the cathode lens 12 is weak in the horizontal direction and the object point tends to be generated far from the cathode. On the contrary, the action of the cathode lens 12 acts strongly and the object point tends to be generated near the cathode. Thereby the location of the object in horizontal direction conforms with that in the vertical direction. As a result, the optimum focus voltages in the horizontal direction is equal to that in the vertical direction so that the lens action of the quadrupole lens is not weakened. Thus, the necessary action of the quadrupole lens can be obtained. A spot is an illuminated area where object point 11 is focused by the lens action and appears as an image. Therefore, in the horizontal direction where the object point 11 is small, the spot becomes small. On the other hand, in the vertical direction where the object point is large, the spot becomes large. Consequently, the distortion of the spot in a horizontally oblong shape can be compensated at the peripheral portion.

The vertically oblong beam of the control electrode 2 can be obtained by properly deciding the ratio of the vertical beam diameter to the horizontal beam diameter, and the thickness of the electrode plate at the peripheral portion in the horizontal and vertical direction. In order to compensate the distortion of the spot in the horizontally oblong shape at the peripheral portion of the screen, the diameter of the beam is expanded in the horizontal direction and strongly focused in the vertical direction, by the method of providing beam through holes that are asymmetric axially in the accelerating electrode or the like. But this method has a problem in that the horizontal diameter of the beam is excessively expanded under large current so that the spot diameter increases due to the aberration of the main lens. However, according to the method of providing the above-mentioned control electrode 2, the beam is strongly focused in horizontal direction and scarcely affected by the spherical aberration so that the increase in the spot diameter in the horizontal direction can be inhibited.

The above-mentioned effect by the control electrode 2 having beam through holes that are oblong vertically is obtained when the spot is focused at the peripheral portion of the screen. In other words, this effect is enhanced in the electron gun that has the quadrupole lens compensating an over-focusing in the vertical direction due to the magnetic field. In the case where the electron gun does not have a quadrupole lens, this effect can not be obtained, because the spot in the vertical direction is not focused so that the spot with haze in its core portion appears. More specifically, even if the object point in the vertical direction becomes large and the core becomes large, the spot diameter is not changed because of the haze.

Figure 41:
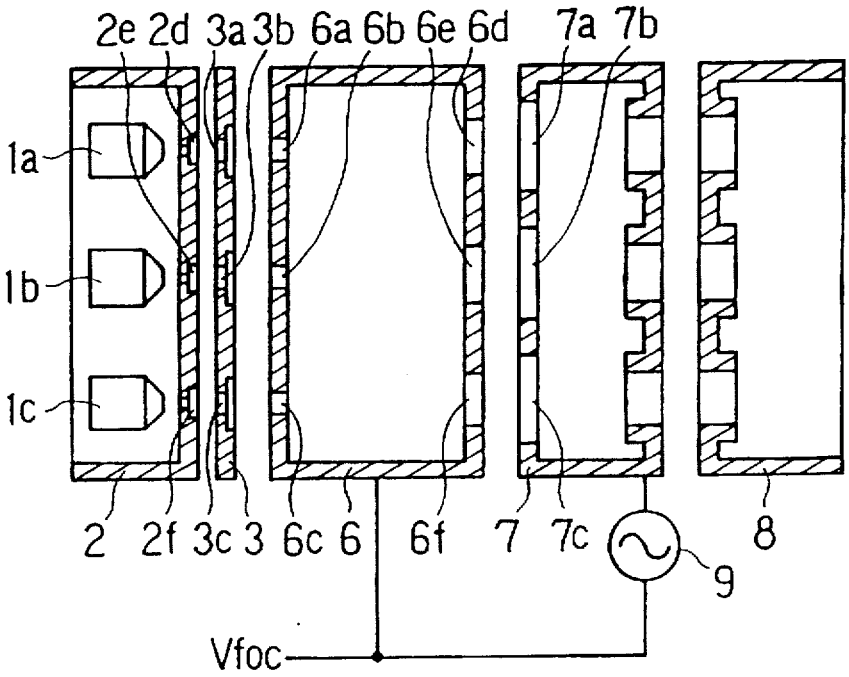
FIG. 41 shows a modification of the electron gun according to FIG. 35.
Figure 42:
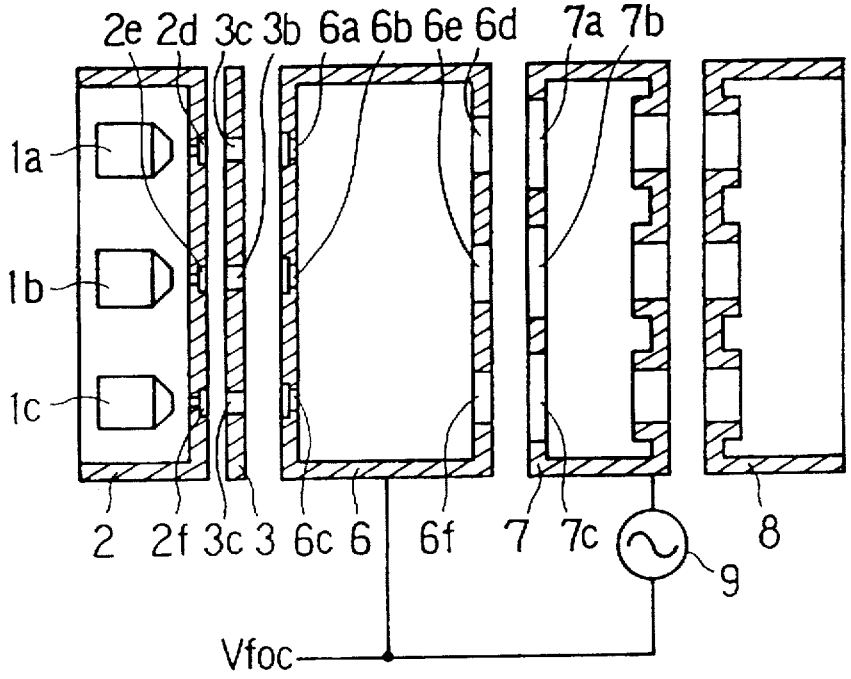
FIG. 42 shows an alternative modification of the electron gun according to FIG. 35.
Figure 43:
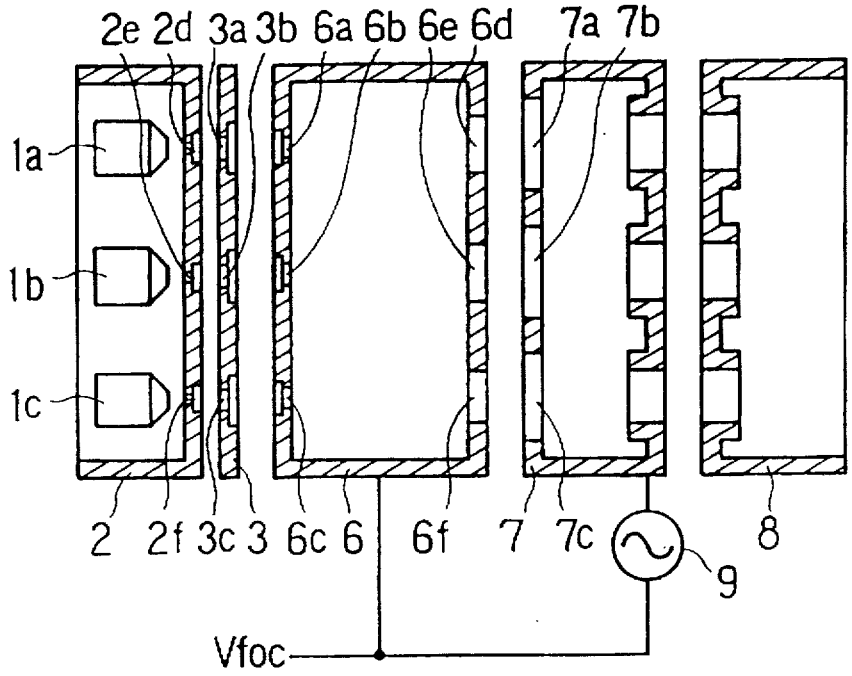
FIG. 43 shows an alternative modification of the electron gun according to FIG. 35.

Referring now to FIGS. 41–43, there are illustrated the modifications of the embodiment of FIGS. 35–38. In the modifications shown in FIG. 41, the accelerating electrode 3 comprises beam through holes having step-like cross sections. The accelerating electrode 3 has horizontally oblong concave portions (rectangular holes) on its side facing the first focusing electrode 6. In the modifications shown in FIG. 42, the box-like first focusing electrode 6 comprises beam through holes having step-like cross sections. The first focusing electrode 6 has vertically oblong concave portions (rectangular holes) on its side facing the accelerating electrode 3. In the modifications shown in FIG. 43, both the accelerating electrode 3 and the face of the first focusing electrode 6 facing the accelerating electrode 3 have the beam through holes having the above-mentioned step-like cross sections.

These beam through holes having step-like cross section act to strongly focus the vertical diameter of the beam. In other words, the beam through holes of the control electrode 2 that are oblong vertically can inhibit an excessive increase in the vertical diameter of the beam. As a result, the excessive increase of the vertical diameter of the spot due to the spherical aberration can be inhibited.

The three beam through holes are not necessarily surrounded separately by the horizontally rectangular concave portions. As shown in FIG. 14, three beam through holes may be surrounded by one horizontally rectangular concave portion. As a method for forming the beam through holes having the step-like cross section, the same method as shown in FIGS. 15 and 16 can be employed. In this method, circular holes are provided on the accelerating electrode 3 or the first auxiliary electrode 4, horizontally oblong or vertically oblong holes are provided on a different electrode plate and then the two are welded one over the other.

Figure 44:
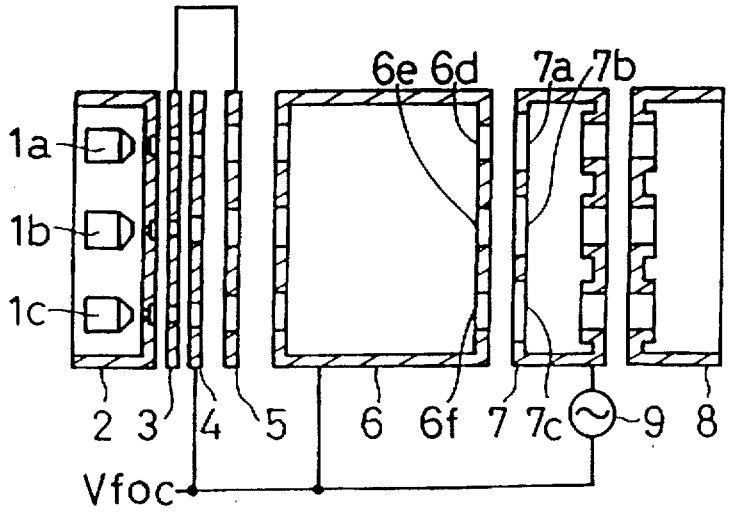
FIG. 44 is a cross sectional view of the electron gun of the color picture tube of the seventh embodiment of the present invention.
Figure 45:
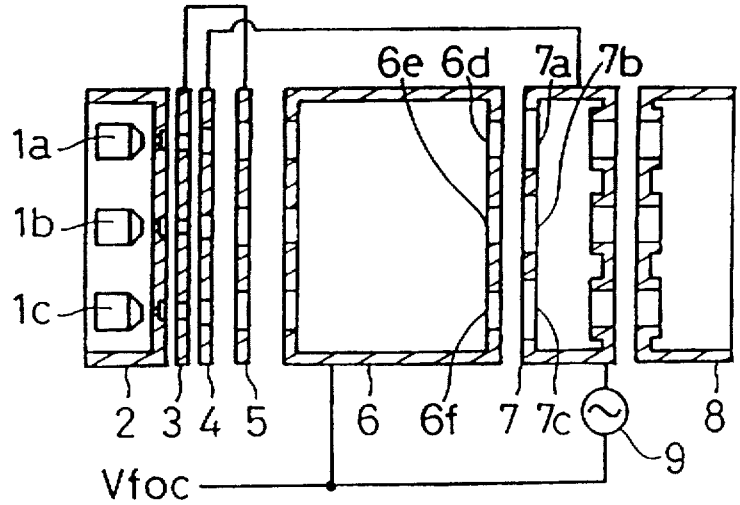
FIG. 45 is a cross sectional view of the electron gun of the color picture tube of the eighth embodiment of the present invention.
Figure 46:
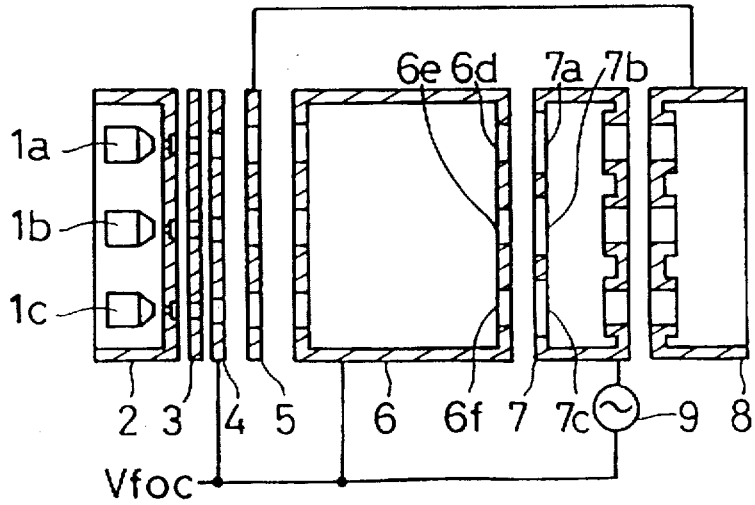
FIG. 46 is a cross sectional view of the electron gun of the color picture tube of the ninth embodiment of the present invention.

Referring now to FIGS. 44–46, there are illustrated the seventh to ninth embodiments of the present invention. In these embodiments, the first auxiliary electrode 4 and second auxiliary electrode 5 are provided between the accelerating electrode 3 and the first focusing electrode 6. Referring to FIG. 44, there is shown the seventh embodiment of the electron gun in which the focus voltage, Vfoc which is the same as that applied to the first focusing electrode 6, was applied to the first auxiliary electrode 4, and a voltage, which is the same as applied to the accelerating electrode 3, was applied to the second auxiliary electrode 5. Referring to FIG. 45, there in shown the eighth embodiment of the electron gun in which a voltage, which is the same as that applied to the second focusing electrode 7, was applied to the first auxiliary electrode 4, and a voltage, which is the same as that applied to the accelerating electrode 3, was applied to the second auxiliary electrode 5. Both the seventh and eighth embodiments strongly focus the beams by the action of two prefocus lenses. Referring to FIG. 46, there is shown the ninth embodiment of a multi-step focusing type electron gun in which the focus voltage Vfoc, which is the same as that applied to the first focusing electrode 6, was applied to the first auxiliary electrode 4, and a voltage, which is the same as that applied to the final accelerating electrode 8, was applied to the second auxiliary electrode 5.

The seventh to ninth embodiments of the electron gun have the same structure as the sixth embodiment except in the lens system focusing beams on the phosphor screen. Consequently, by means of the control electrode 2 having the beam through holes that are oblong vertically, the distortion of the spot in a horizontally oblong shape can be improved at the peripheral spot in the phosphor screen, as is the same in the sixth embodiment.

Figure 47:
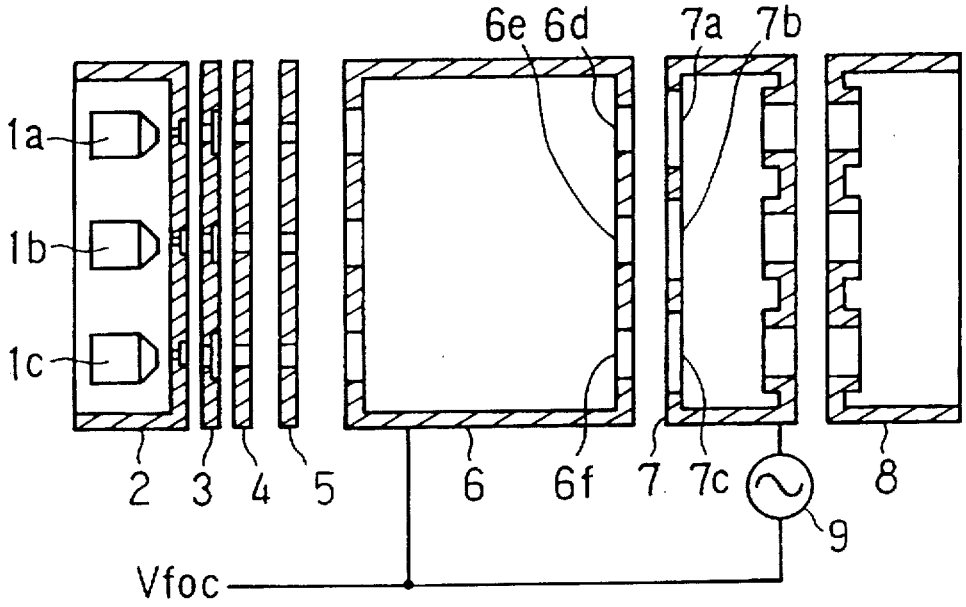
FIG. 47 shows a modification of the electron gun according to FIGS. 44–46.
Figure 48:
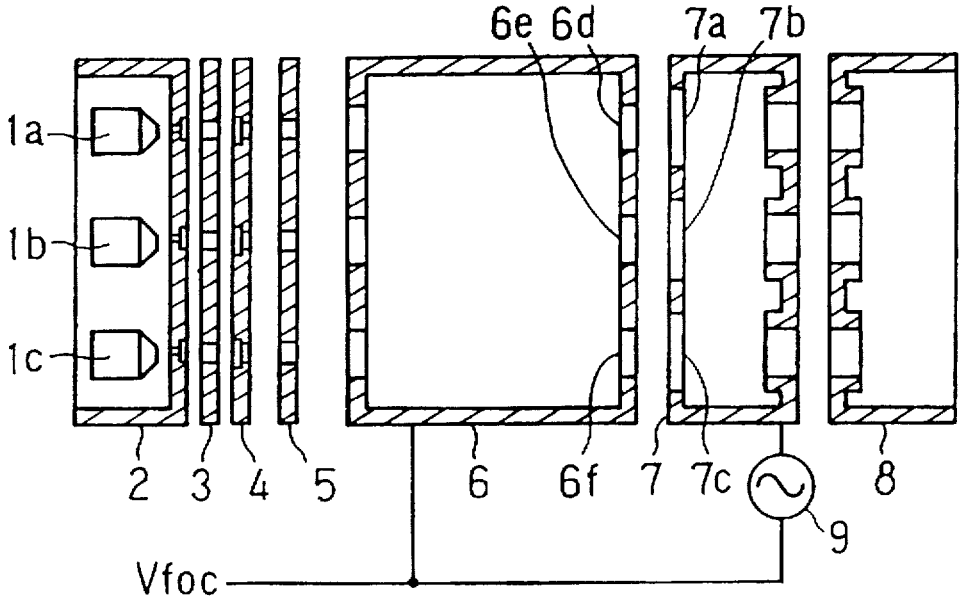
FIG. 48 shows an alternative modification of the electron gun according to FIGS. 44–46.
Figure 49:
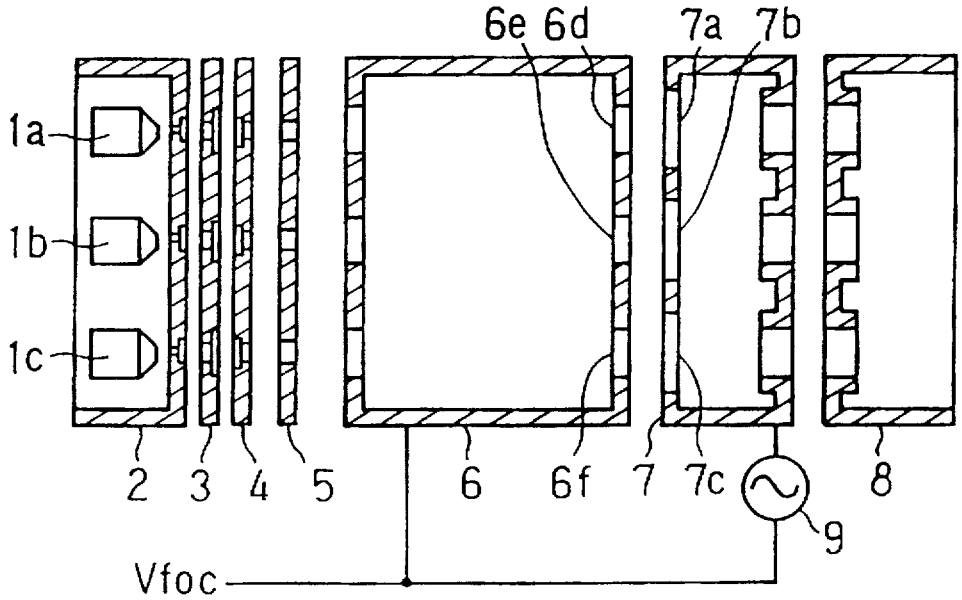
FIG. 49 shows an alternative modification of the electron gun according to FIGS. 44–46.

Referring now to FIGS. 47–49, there are illustrated the modifications of these embodiments. In the modification shown in FIG. 47, the accelerating electrode 3 comprises beam through holes having step-like cross sections. The accelerating electrode 3 has horizontally oblong concave portions (rectangular holes) on its side facing the first auxiliary electrode 4. In the modifications shown in FIG. 48, the first auxiliary electrode 4 comprises beam through holes having step-like cross sections. The first auxiliary electrode 4 has vertically oblong concave portions (rectangular holes) on the side facing the accelerating electrode 3. In the modification shown in FIG. 49, both the accelerating electrode 3 and the first auxiliary electrode 4 have the beam through holes having the above-mentioned step-like cross sections.

The elevational views of the accelerating electrode 3 and the first auxiliary electrode 4 are omitted, but they are the same as shown in the modification of the first embodiment. Moreover, in FIGS. 47–49, there is not shown the voltage applying line connecting each of the accelerating electrode 3, the first auxiliary electrode 4 and the second auxiliary electrode 5. But each connection can employ the methods shown in FIGS. 44 to 46.

These beam through holes act for decreasing the beams in the vertical direction. In other words, beam through holes of the control electrode 2 that are oblong vertically can inhibit excessive increase in the vertical diameter of the beam. As a result, an excessive increase in the vertical diameter of the spot due to the spherical aberration can be inhibited.

The beam through holes of the other electrodes can obtain the same effect by providing the above-mentioned step-like cross sections. For example, the vertically oblong concave portions may be provided on the face of the first auxiliary electrode 4 facing the second auxiliary electrode 5, or the face of the first focusing electrode 6 facing the second auxiliary electrode 5. Moreover, the horizontally oblong concave portions can be provided on the face of the second auxiliary electrode 5 facing the first auxiliary electrode 4, or the face of the second auxiliary electrode 5 facing the first focusing electrode 6.

The three beam through holes are not necessarily surrounded separately by the horizontally rectangular concave portions. As shown in FIG. 14, three beam through holes may be surrounded together by one horizontally rectangular concave portion. As a method for forming the beam through holes having the step-like cross section, the same method as shown in FIGS. 15 and 16 can be employed. In this method, circular holes were provided on the accelerating electrode 3 or the first auxiliary electrode 4, and horizontally oblong or vertically oblong holes were provided on another electrode plate, and then the two were welded one over the other.

Figure 50:
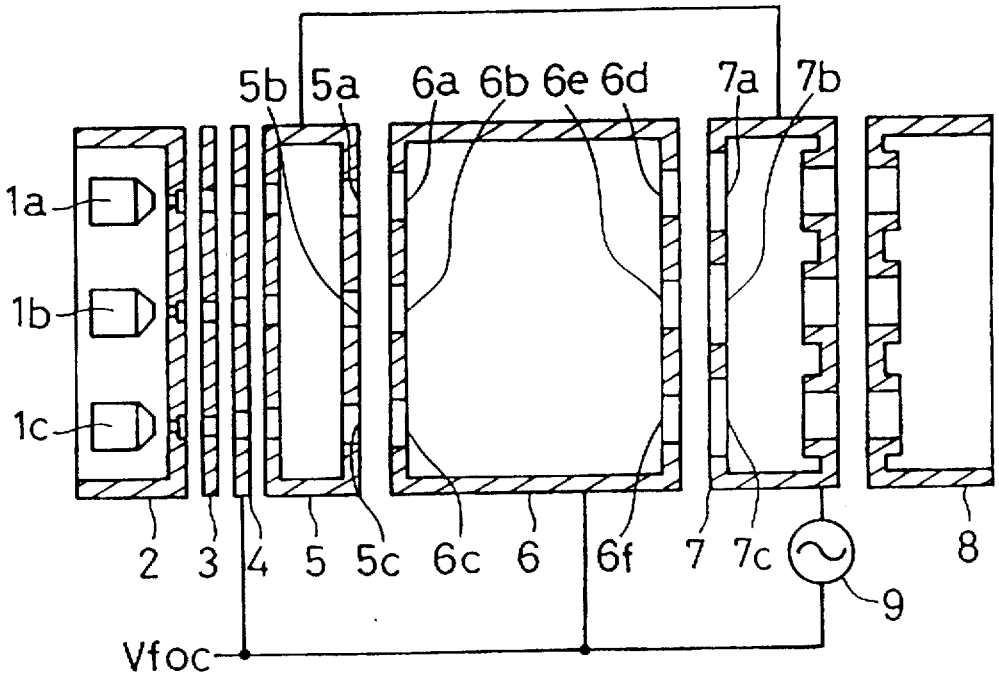
FIG. 50 is a cross section view of the electron gun of the color picture tube of the tenth embodiment of the present invention.
Figure 51:
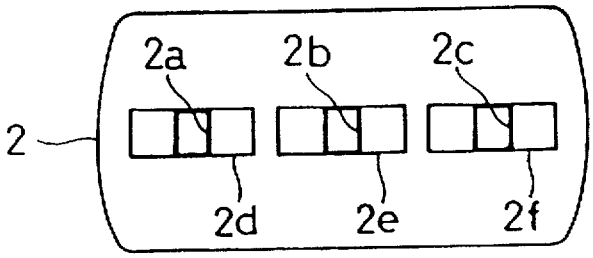
FIG. 51 is an elevational view showing the control electrode of the electron gun according to FIG. 50.

Referring now to FIG. 50, there is illustrated the tenth embodiment of the present invention. As shown in FIG. 50, the in-line electron gun comprises three cathodes 1*a*, 1*b* and 1*c* which are aligned, a control electrode 2, an accelerating electrode 3, the first auxiliary electrode 4, the second auxiliary electrode 5, the first focusing electrode 6, the second focusing electrode 7 and the final accelerating electrode 8. As shown in FIGS. 50 and 51, the control electrode 2 comprises beam through holes having a step-like cross section. More specifically, the control electrode have the beam through holes 2*a*, 2*b* and 2*c* that are oblong vertically (rectangular shaped) on its side facing the cathode 1 and beam through holes 2*d*, 2*e* and 2*f* that are oblong horizontally on its side facing the accelerating electrode 3.

Figure 52:
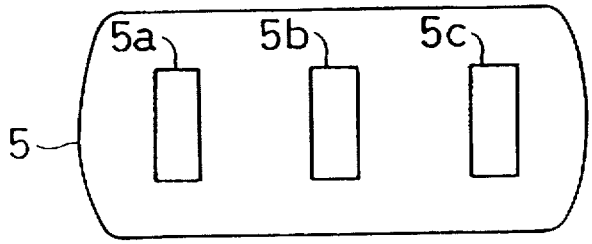
FIG. 52 is an elevational view showing the side of the second control electrode facing the first focusing electrode of the electron gun according to FIG. 50.
Figure 53:
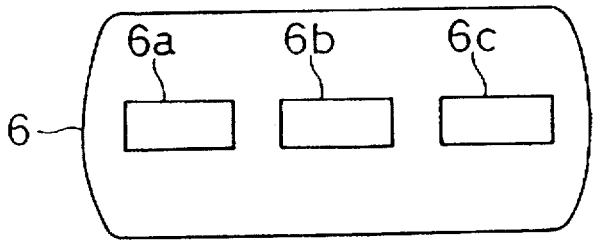
FIG. 53 is an elevational view showing the side of the first focusing electrode facing the second focusing electrode of the electron gun according to FIG. 50.
Figure 54:
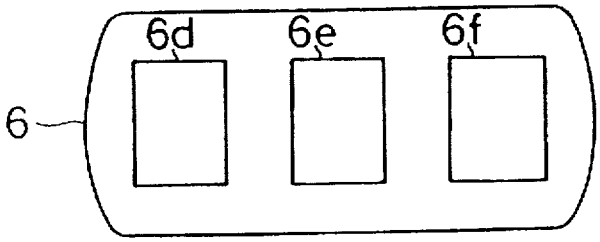
FIG. 54 is an elevational view showing the side of the first focusing electrode facing the second focusing electrode of the electron gun according to FIG. 50.
Figure 55:
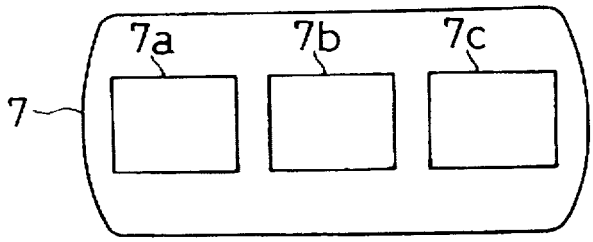
FIG. 55 is an elevational view showing the side of the second focusing electrode facing the first focusing electrode of the electron gun according to FIG. 50.

As shown in FIG. 52, beam through holes 5*a*, 5*b* and 5*c* that are oblong vertically (rectangular shaped) are provided on the face of the box-like second auxiliary electrode 5 facing the first focusing electrode 6. As shown in FIG. 53, the beam through holes 6*a*, 6*b* and 6*c* that are oblong horizontally (rectangular shaped) are provided on the face of the box-like first focusing electrode 6 facing the auxiliary electrode 5. As shown in FIG. 54, beam through holes 6*d*, 6*e* and 6*f* that are oblong vertically (rectangular shaped) are provided on the face of the box-like first focusing electrode 6 facing the second focusing electrode 7. As shown in FIG. 55, beam through holes 7*a*, 7*b* and 7*c* that are oblong horizontally (rectangular shaped) are provided on the face of the box-like second focusing electrode 7 facing the first focusing electrode 6. A focusing voltage Vfoc is applied to the first auxiliary electrode 4 and the first focusing electrode 6. A compound voltage, in which a dynamic voltage which increases in accordance with an increase in the deflection angle of an beam is superimposed on the focusing voltage Vfoc, is applied to the second auxiliary electrode 5 and the second focusing electrode 7.

Figure 56:
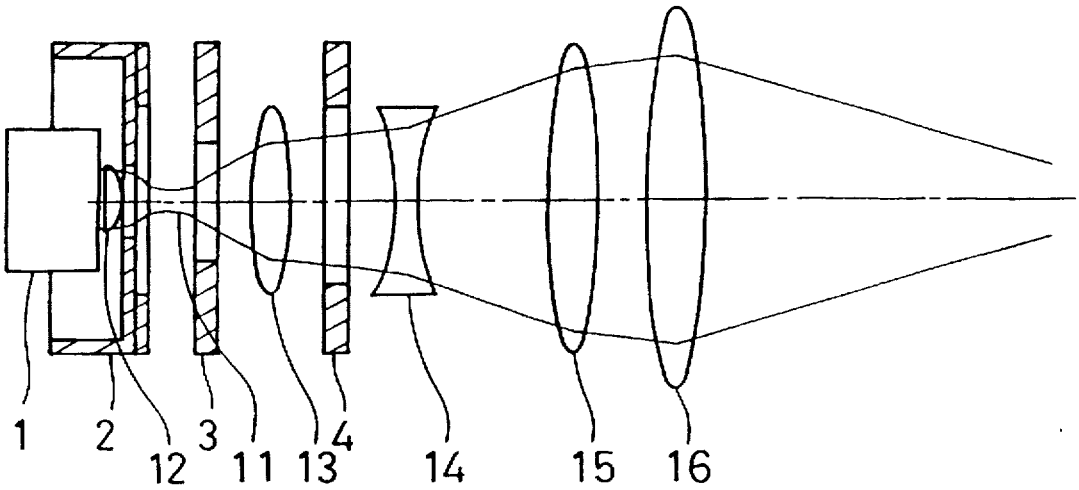
FIG. 56 is a view in which an optical lens is replaced by a horizontal lens field acting on a beam of the electron gun according to FIG. 50.
Figure 57:
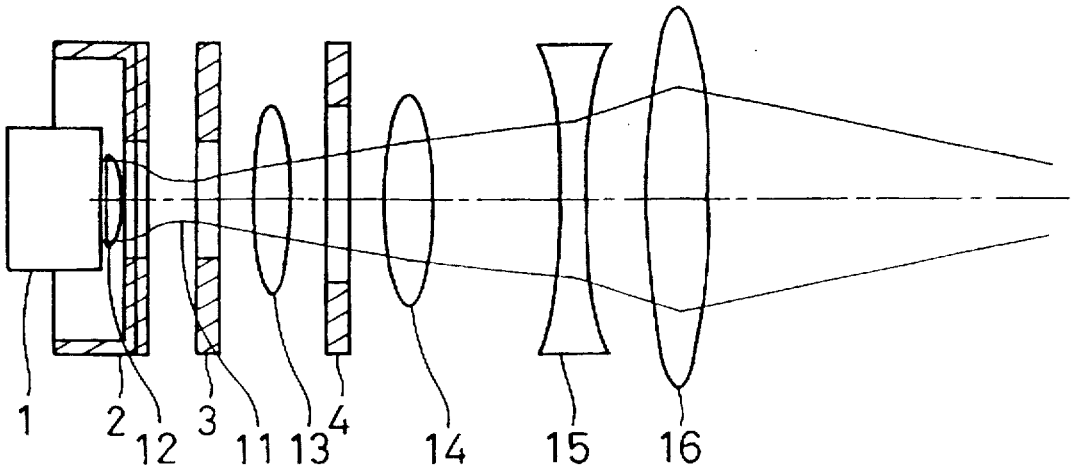
FIG. 57 is a view in which an optical lens is replaced by a vertical lens field acting on a beam of the electron gun according to FIG. 50.

A detailed behavior of the beam in the horizontal direction will be explained based on FIG. 56, and a detailed behavior of the beam in the vertical direction will be explained based on FIG. 57. As a dynamic voltage is applied to the second auxiliary electrode and second focusing electrode, a potential difference is generated between the second auxiliary electrode 5 and the first focusing electrode 6, and between the first focusing electrode 6 and the second focusing electrode 7. Thereby, between the second auxiliary electrode 5 and the first focusing electrode 6, the quadrupole lens 14 is generated, which expands a beam in the horizontal direction and decreases a beam in the vertical direction. On the other hand, between the first focusing electrode 6 and the second focusing electrode 7, the quadruple lens 15 is generated that decreases a beam in the horizontal direction, and expands a beam in the vertical direction. Moreover, the potential difference between the second focusing electrode 7 and the accelerating electrode 8 decreases, thus weakening the main lens. The quadrupole lens 15 cancels an overfocusing in the vertical direction due to the distorted magnetic field. At the same time, the main lens 16, whose lens action becomes weak, compensates the defocusing due to the increase in the distance to the phosphor screen during deflection. Consequently, the beams can be focused at the peripheral portion on the phosphor screen. Moreover, by the action of the quadrupole lens 14, the difference of the incident angle in the horizontal and vertical direction decreases so that the distortion of the spot can be inhibited at the peripheral portion on the screen.

The beam through holes are provided on the control electrode 2 as shown in FIG. 51, as is same in the sixth embodiment, so that the spot diameter in the horizontal direction is small and that the spot that in the vertical direction is large. Thereby the location of the object point in the horizontal direction conforms with that in the vertical direction. As a result, the lens action of the quadrupole lens is not decreased. Consequently, the necessary action of the quadrupole lens can be obtained. The spot is an illuminated area where object point 11 is focused by the lens action and appears as an image. Therefore, in the horizontal direction where the object point 11 is small, the spot becomes small. On the other hand, in the vertical direction where the object point is large, the spot becomes large. Consequently, the distortion in a horizontally oblong shape can be compensated.

The vertically oblong beam can be obtained by properly deciding the ratio of the beam dimension in the vertical direction to that in the horizontal direction and the thickness of the plate at the peripheral portion in the horizontal direction and in the vertical direction for the control electrode 2. The beam is decreased in the horizontal direction and the spherical aberration of the main lens 16 can be inhibited. As a result, the increase in the spot diameter under the large current can be inhibited.

Figure 58:
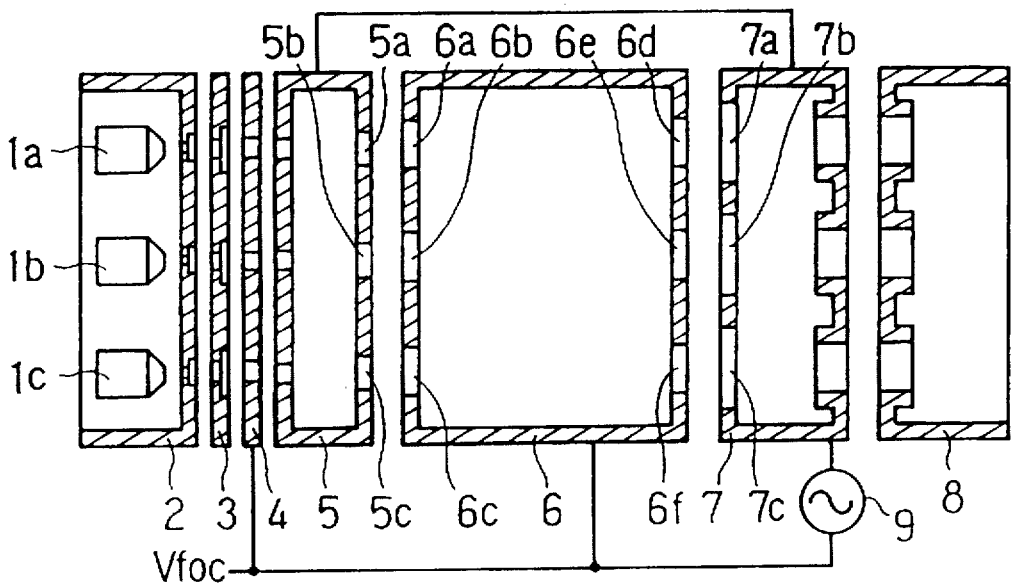
FIG. 58 shows a modification of the electron gun according to FIG. 50.
Figure 59:
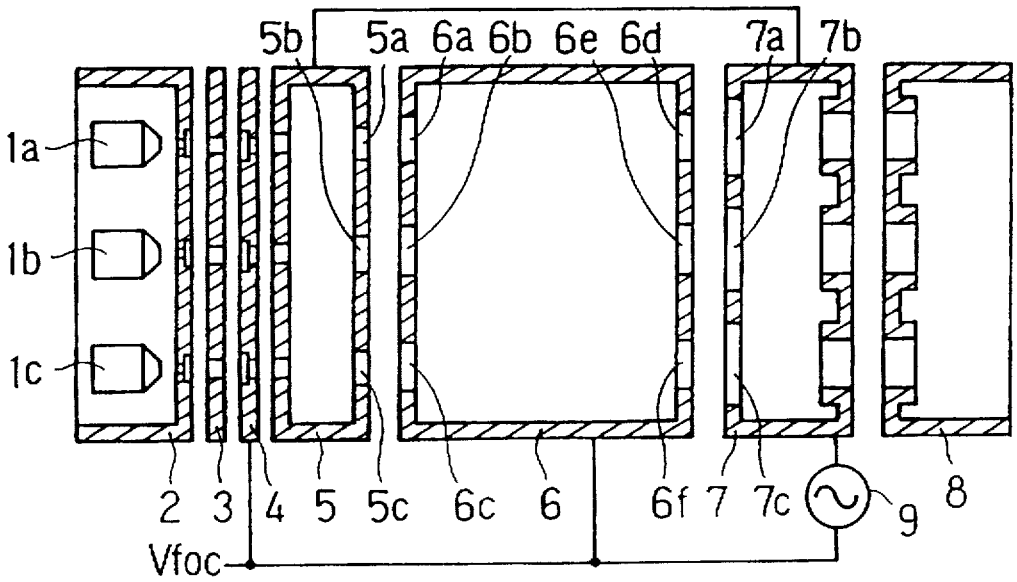
FIG. 59 shows an alternative modification of the electron gun according to FIG. 50.
Figure 60:
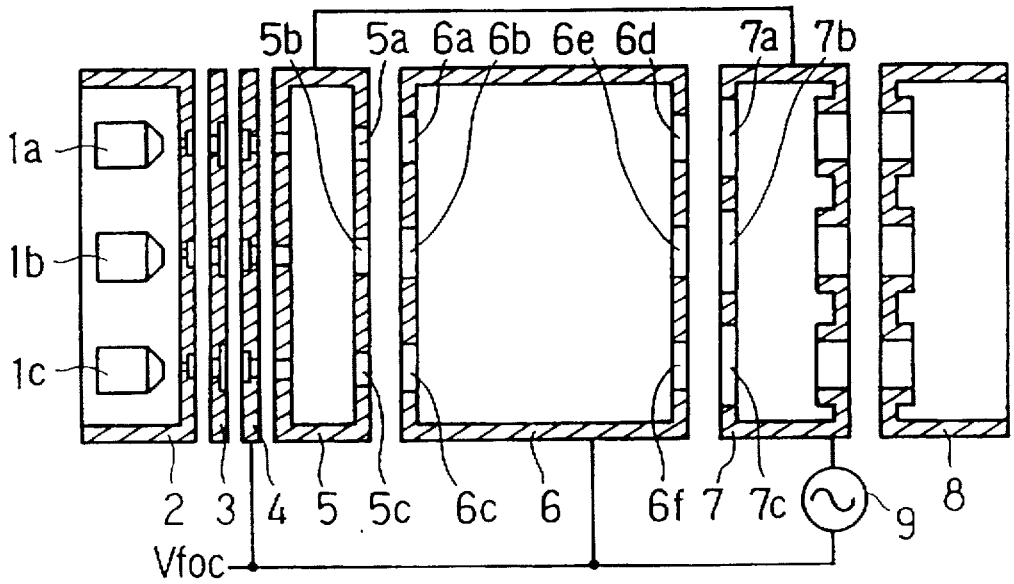
FIG. 60 shows an alternative modification of the electron gun according to FIG. 50.

Referring now to FIGS. 58–60, there are illustrated the modifications of these embodiments. In the modifications shown in FIG. 58, the accelerating electrode 3 comprises beam through holes having step-like cross sections. The accelerating electrode 3 has horizontally oblong concave portions (rectangular holes) on its side facing the first auxiliary electrode 4. In the modifications shown in FIG. 59, the first auxiliary electrode 4 comprises beam through holes having step-like cross sections. The first auxiliary electrode 4 has vertically oblong concave portions (rectangular holes) on the side facing the accelerating electrode 3. In the modifications shown in FIG. 60, both the accelerating electrode 3 and the first auxiliary electrode 4 have the beam through holes having the above-mentioned step-like cross sections.

These beam through holes act for decreasing the vertical diameter of the spot. In other words, beam through holes of the control electrode 2 that are oblong vertically can inhibit an excessive increase in the vertical diameter of the beam. As a result, an excessive increase in the vertical diameter of the spot due to the spherical aberration can be inhibited.

The three beam through holes are not necessarily surrounded separately by the horizontally rectangular concave portions. As shown in FIG. 14, three beam through holes may be surrounded together by one horizontally rectangular concave portion. As a method for forming the beam through holes having the step-like cross section, the same method as shown in FIGS. 15 and 16 can be employed. In this method, circular holes were provided on the accelerating electrode 3 or the first auxiliary electrode 4, and horizontally oblong or vertically oblong holes were provided on the other electrode plate, and then the two were welded one over the other.

Figure 61:
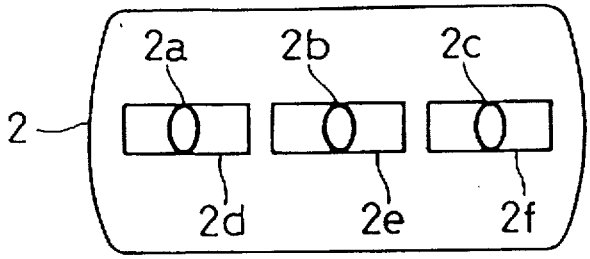
FIG. 61 is an elevational view showing an alternative shape of beam through holes provided on the control electrode of each embodiment.
Figure 62:
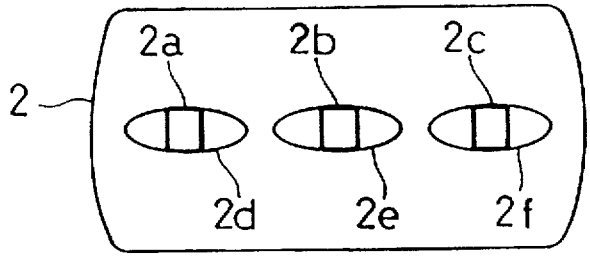
FIG. 62 is an elevational view showing an alternative shape of beam through holes provided on the control electrode of each embodiment.
Figure 63:
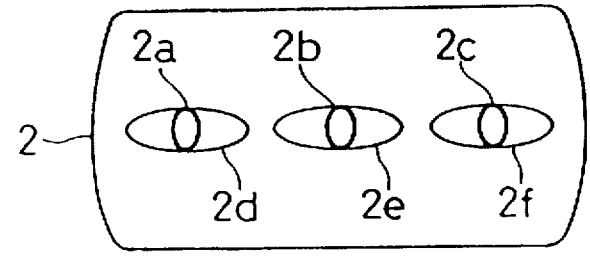
FIG. 63 is an elevational view showing an alternative shape of beam through holes provided on the control electrode of each embodiment.
Figure 64:
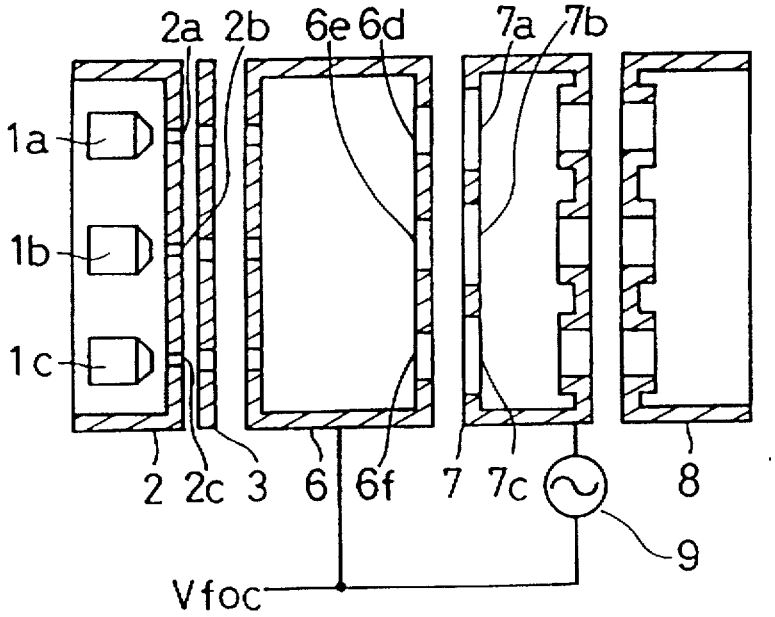
FIG. 64 (PRIOR ART)
FIG. 64 is a cross sectional view of the electron gun of the color picture tube of the prior art.
Figure 65:
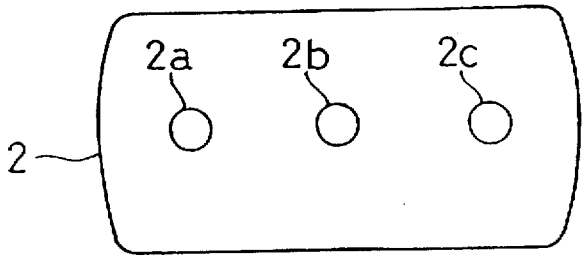
FIG. 65 (PRIOR ART)
FIG. 65 is an elevational view showing the control electrode of the electron gun according to FIG. 64.
Figure 66:
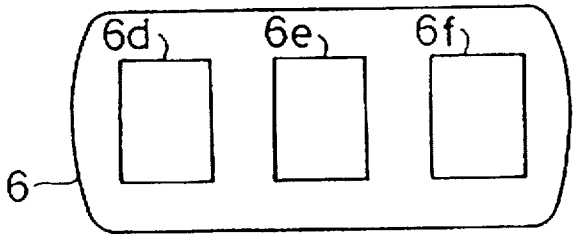
FIG. 66 (PRIOR ART)
FIG. 66 is an elevational view showing the side of the first focusing electrode facing the second focusing electrode of the electron gun according to FIG. 64.
Figure 67:
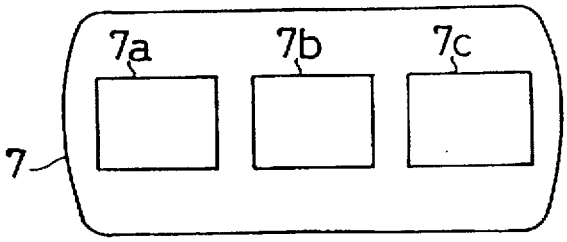
FIG. 67 (PRIOR ART)
FIG. 67 is an elevational view showing the side of the first focusing electrode facing the second focusing electrode of the electron gun according to FIG. 64.

In the sixth to tenth embodiments and their modifications mentioned above, the beam through hole of the control electrode 2 is not limited to a rectangular shape. It may be a non-circular shape such as an elliptical shape. Moreover as shown in FIGS. 61–63, the combination of shapes of the beam through holes on the side of the control electrode 2 facing the cathode 1 and those on the side of the control electrode 2 facing the accelerating electrode 3 includes various combination such as a combination of elliptical and rectangular shapes or a combination of elliptical shapes.

In addition, the control electrode 2 can be formed by welding two electrode plates, an electrode plate having the beam through holes that are oblong vertically and an electrode plate having the beam through holes that are oblong horizontally. According to this method, in the case where the vertical dimension of the beam through holes on its side facing the cathode and that on its side facing accelerating electrode 3 has the same size, the welding procedure becomes easy. Alternatively, the control electrode 2 having step-like cross sections can be formed by pressing a sheet metal.

Moreover, in each embodiment mentioned above, the beam through holes was controlled to be asymmetric with respect to a beam axis by employing the non-circular beam through holes. Other structures may be possible, for example, electrode portion is provided in adjacent to the circular through holes, which extends from the plate to the direction of the beam axis so that the asymmetric structure can be obtained. In this case, the same effect as mentioned above can be obtained.

As stated above, the electron gun of the present invention improves the distortion in a horizontally oblong shape in the spot of the peripheral portion of the screen by providing the beam through holes that are oblong vertically on the control electrode. Moreover, the electron gun can provide the color picture tube that can inhibit the moire generation to improve the resolution at the peripheral portion of the phospher screen even in the condition, for example, when the large current is passed, or a flat panel is employed, or the deflection angle increases.

Moreover, the beam through holes of the control electrode are formed to be oblong vertically on its side facing the cathode and oblong horizontally on its side facing the accelerating electrode so that the location of the object point of vertical and horizontal direction can be conformed with each other. As a result, the quadrupole lens is not weakened and the necessary action of the quadrupole lens can be obtained. The distortion of the spot in a horizontal oblong shape at the peripheral portion can be improved. Moreover, the generation of moire due to the large current or flat panel or increase of the deflection angle can be inhibited, and the resolution at the peripheral portion of the phosphor screen can be improved.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, and all changes which come within the meaning and range of equivalency of the claims are intended to be embraced therein.

What is claimed is:

1. An in-line color picture tube having an electron gun comprising three cathodes which are in-line arranged in the horizontal direction, a control electrode, an accelerating electrode and a focusing electrode system, wherein said focusing electrode system comprises a first focusing electrode to which a predetermined focusing voltage is applied and a second focusing electrode to which a variable voltage is applied that varies in accordance with a deflection angle of an electron beam, said first and second focusing electrodes have beam through holes that are asymmetric with respect to a beam axis, and said control electrode has beam through holes that are oblong vertically.

2. The color picture tube according to claim 1, wherein first and second auxiliary electrodes are provided between said accelerating electrode and said first focusing electrode, said first focusing electrode and said first auxiliary electrode are connected by a conductor, and said second focusing electrode and said second auxiliary electrode are connected by a conductor.

3. The color picture tube according to claim 2, wherein beam through holes arranged on a portion of said first focusing electrode facing said second auxiliary electrode are oblong horizontally, and beam through holes arranged on a portion of said second auxiliary electrode facing said first focusing electrode are oblong vertically.

4. The color picture tube according to claim 1, wherein first and second auxiliary electrodes are provided between said accelerating electrode and said first focusing electrode, said first auxiliary electrode and said first focusing electrode are connected by a conductor, and said second auxiliary electrode and said accelerating electrode are connected by a conductor.

5. The color picture tube according to claim 1, wherein first and second auxiliary electrodes are provided between said accelerating electrode and said first focusing electrode, said first auxiliary electrode and said second focusing electrode are connected by a conductor, and said second auxiliary electrode and said accelerating electrode are connected by a conductor.

6. The color picture tube according to claim 1, wherein a portion where said accelerating electrode and said first focusing electrode are facing each other is asymmetric axially.

7. The color picture tube according to claim 1, wherein said accelerating electrode has beam through holes that are oblong horizontally on its portion facing said first focusing electrode.

8. The color picture tube according to claim 1, wherein said first focusing electrode has beam through holes that are oblong vertically on its portion facing said accelerating electrode.

9. The color picture tube according to claim 1, wherein first and second auxiliary electrodes are provided between said accelerating electrode and said first focusing electrode, and at least one of the facing portions selected from the group consisting of a focusing portion of said accelerating and first auxiliary electrodes, a facing portion of said first and second auxiliary electrodes, and a facing portion of said second auxiliary and first focusing electrodes is asymmetric axially.

10. The color picture tube according to claim 9, wherein said accelerating electrode has beam through holes that are oblong vertically on its portion facing said first auxiliary electrode.

11. The color picture tube according to claim 9, wherein said first auxiliary electrode has beam through holes that are oblong vertically on its portion facing accelerating electrode.

12. The color picture tube according to claim 1, wherein said beam through holes of said control electrode have a shape selected from a rectangular shape or an oval shape.

13. An in-line color picture tube having an electron gun comprising three cathodes which are in-line arranged in the horizontal direction, a control electrode, an accelerating electrode and a focusing electrode system, wherein said focusing electrode system comprises a first focusing electrode to which a predetermined focusing voltage is applied and a second focusing electrode to which a variable voltage is applied that varies in accordance with a deflection angle of an electron beam, said first and second focusing electrode have beam through holes that are asymmetric with respect to a beam axis, and said control electrode has vertically oblong beam through holes on the side facing said cathodes disposed in the bottom of the horizontally oblong recesses on the side facing said accelerating electrode.

14. The color picture tube according to claim 13, wherein first and second auxiliary electrodes are provided between said accelerating electrode and said first focusing electrode, said first focusing electrode and said first auxiliary electrode are connected by a conductor, and said second focusing electrode and said second auxiliary electrode are connected by a conductor.

15. The color picture tube according to claim 14, wherein beam through holes arranged on a portion of said first focusing electrode facing said second auxiliary electrode are oblong horizontally; and beam through holes arranged on a portion of said second auxiliary electrode facing said first focusing auxiliary electrode are oblong vertically.

16. The color picture tube according to claim 13, wherein first and second auxiliary electrodes are provided between said accelerating electrode and said first focusing electrode, said first focusing electrode and said first auxiliary electrode are connected by a conductor, and said second auxiliary electrode and said accelerating electrode are connected by a conductor.

17. The color picture tube according to claim 13, wherein first and second auxiliary electrodes are provided between said accelerating electrode and said first focusing electrode, said first auxiliary electrode and said second focusing electrode are connected by a conductor, and said second auxiliary electrode and said accelerating electrode are connected by a conductor.

18. The color picture tube according to claim 13, wherein a facing portion where said accelerating electrode and said first focusing electrode are facing each other is asymmetric axially.

19. The color picture tube according to claim 13, wherein said accelerating electrode has beam through holes that are oblong horizontally on the portion facing said first focusing electrode.

20. The color picture tube according to claim 13, wherein said first focusing electrode has beam through holes that are oblong vertically on the portion facing said accelerating electrode.

21. The color picture tube according to claim 13, wherein first and second auxiliary electrodes are provided between said accelerating electrode and said first focusing electrode, and at least one of the facing portions selected from the group consisting of a portion of said accelerating and said first auxiliary electrode, a facing portion of said first and second electrodes and a facing portion of said second auxiliary and said first focusing electrode is asymmetric axially.

22. The color picture tube according to claim 21, wherein said accelerating electrode has beam through holes that are oblong vertically on its portion facing said first auxiliary electrode.

23. The color picture tube according to claim 21, wherein said first auxiliary electrode has beam though holes that are oblong vertically on its portion facing accelerating electrode.

24. The color picture tube according to claim 13, wherein said beam through holes of said control electrode have a shape selected from a rectangular shape or an oval shape.

* * * * *